US009041705B2

(12) United States Patent
Han et al.

(10) Patent No.: US 9,041,705 B2
(45) Date of Patent: May 26, 2015

(54) ORGANIC LIGHT EMITTING DISPLAY DEVICE

(71) Applicant: LG Display Co., Ltd., Seoul (KR)

(72) Inventors: In Hyo Han, Gyeonggi-do (KR); Bum Sik Kim, Gyeonggi-do (KR); Young Jun Hong, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 57 days.

(21) Appl. No.: 14/069,561

(22) Filed: Nov. 1, 2013

(65) Prior Publication Data

US 2014/0139510 A1 May 22, 2014

(30) Foreign Application Priority Data

Nov. 22, 2012 (KR) ..... 10-2012-0132996

(51) Int. Cl.
*G09G 3/32* (2006.01)

(52) U.S. Cl.
CPC ..... *G09G 3/3291* (2013.01); *G09G 3/3233* (2013.01); *G09G 2300/0842* (2013.01); *G09G 2300/0861* (2013.01); *G09G 2300/0866* (2013.01); *G09G 2320/0233* (2013.01); *G09G 2320/0295* (2013.01); *G09G 2320/043* (2013.01)

(58) Field of Classification Search
CPC ..... G09G 3/32; G09G 3/3233; G09G 2300/0842; G09G 2300/0861; G09G 3/3291; G09G 2320/0233; G09G 2320/0295; G09G 2320/043; G09G 2300/0866
USPC ..... 345/76–83, 204–215
See application file for complete search history.

(56) References Cited

U.S. PATENT DOCUMENTS

| | | | | |
|---|---|---|---|---|
| 8,810,139 | B2 * | 8/2014 | Kim et al. | 315/169.3 |
| 2006/0007070 | A1 | 1/2006 | Shih | |
| 2006/0022204 | A1 | 2/2006 | Steer | |
| 2006/0208971 | A1 | 9/2006 | Deane | |
| 2007/0195020 | A1 | 8/2007 | Nathan et al. | |
| 2010/0001983 | A1 | 1/2010 | Abe | |
| 2011/0057966 | A1 | 3/2011 | Ono | |
| 2014/0152633 | A1 * | 6/2014 | Park et al. | 345/207 |
| 2014/0176401 | A1 * | 6/2014 | Kim et al. | 345/76 |
| 2014/0176525 | A1 * | 6/2014 | Woo et al. | 345/212 |

* cited by examiner

*Primary Examiner* — Vijay Shankar
(74) *Attorney, Agent, or Firm* — Morgan, Lewis & Bockius LLP

(57) ABSTRACT

An organic light emitting display device includes a panel driver and a display panel including a plurality of pixels having a pixel circuit, a first driving voltage terminal connected to the driving transistor, a light emitting element, a second driving voltage terminal connected to the light emitting element, and a capacitor connected between a gate and source electrode of the driving transistor, the panel driver to drive the pixel circuit in a data charging period in which a difference between a data and reference voltage is charged into the capacitor, and a light emitting period in which the driving transistor receives a first driving voltage from the first driving voltage terminal and is turned on according to the voltage charged into the capacitor during the data charging period, whereby a current is supplied to the light emitting element which thereby emits light.

20 Claims, 13 Drawing Sheets

ORGANIC LIGHT EMITTING DISPLAY DEVICE

CROSS-REFERENCE TO RELATED APPLICATIONS

This application claims the benefit of priority of Korean Patent Application No. 10-2012-0132996 filed on Nov. 22, 2012, which is hereby incorporated by reference as if fully set forth herein.

BACKGROUND

1. Field of the Disclosure

The present disclosure relates to an organic light emitting display device.

2. Discussion of the Related Art

Recently, with the advancement of multimedia, the importance of flat panel display (FPD) devices is increasing. Therefore, various FPD devices such as liquid crystal display (LCD) devices, plasma display panel (PDP) devices, and organic light emitting display devices are being used practically. In such FPD devices, the organic light emitting display devices may typically have a fast response time of 1 ms or less. The organic light emitting display devices may also have low power consumption, and may have no limitations in viewing angle because the organic light emitting display devices self-emit light. Accordingly, the organic light emitting display devices are attracting much attention as next generation FPD devices.

General organic light emitting display devices may include a display panel having a plurality of pixels that are respectively formed in a plurality of pixel areas defined by intersections between a plurality of data lines and a plurality of gate lines, and a panel driver that drives the plurality of pixels to emit light.

Each of the pixels of the display panel, as illustrated in FIG. 1, may include a switching transistor ST, a driving transistor DT, a capacitor Cst, and a light emitting element OLED. The switching transistor ST may be turned on by a gate signal GS supplied from a gate line G, and may supply a data voltage Vdata, supplied from a data line D, to the driving transistor DT. The driving transistor DT may be turned on with the data voltage Vdata supplied from the switching transistor ST, and may control a data current Ioled which flows to the light emitting element OLED according to a driving voltage VDD supplied through a power line. The capacitor Cst may be connected between a gate and source of the driving transistor DT, may store a voltage corresponding to the data voltage Vdata supplied to the gate of the driving transistor DT, and may turn on the driving transistor DT with the stored voltage. The light emitting element OLED may be electrically connected between the source of the driving transistor DT and a ground line VSS, and may emit light with the data current Ioled supplied from the driving transistor DT.

Each pixel of the general organic light emitting display device may control a level of the data current Ioled (which flows from the driving voltage VDD terminal to the light emitting element OLED) with a switching time of the driving TFT DT based on the data voltage Vdata to thereby emit light from the light emitting element OLED and display a certain image.

However, in the general organic light emitting display devices, the threshold voltage (Vth) and mobility characteristics of a plurality of the driving transistors DT are different depending on a position of the display panel due to a non-uniformity of a process of manufacturing a thin film transistor (TFT). For this reason, in the general organic light emitting display devices, despite the same data voltage Vdata being applied to the driving transistors DT of the respective pixels, a deviation of currents flowing in the organic light emitting elements (OLEDs) can render the devices unable to realize a uniform image quality.

SUMMARY

Accordingly, the present embodiments are directed to providing an organic light emitting display device that substantially obviates one or more problems due to limitations and disadvantages of the related art.

An aspect of the present embodiments is directed to providing an organic light emitting display device for compensating for a threshold voltage of a driving transistor that emits light from an organic light emitting element of each of a plurality of pixels.

Another aspect of the present embodiments is directed to providing an organic light emitting display device for increasing a current efficiency with respect to a data voltage and uniformizing brightness.

Additional advantages and features of the present embodiments will be set forth in part in the description which follows and in part will become apparent to those having ordinary skill in the art upon examination of the following or may be learned from practice of the present embodiments. The objectives and other advantages of the present embodiments may be realized and attained by the structure particularly pointed out in the written description and claims hereof as well as the appended drawings.

To achieve these and other advantages and in accordance with the present embodiments, as embodied and broadly described herein, there is provided an organic light emitting display device including: a display panel configured to include a plurality of pixels including a pixel circuit that is driven in a data charging period, in which a difference voltage between a data voltage and a reference voltage is charged into a capacitor connected between a gate and source electrodes of a driving transistor, and a light emitting period in which the driving transistor receiving a first driving voltage is turned on according to the charged voltage of the capacitor, and a current is supplied to a light emitting element connected between the driving transistor and a second driving voltage terminal to emit light from the light emitting element emits light; and a panel driver configured to supply the data voltage and the reference voltage to the plurality of pixels at every data charging period, and simultaneously change a level of the first driving voltage or second driving voltage supplied to the plurality of pixels at every data charging period.

In another aspect of the present embodiments, there is provided an organic light emitting display device including: a display panel configured to include a plurality of pixels including a pixel circuit that is driven in a data charging period, in which a difference voltage between a first driving voltage and a data voltage is charged into a capacitor connected between a gate and source electrodes of a driving transistor, and a light emitting period in which the driving transistor receiving the first driving voltage is turned on according to the charged voltage of the capacitor, and a current is supplied to a light emitting element connected between the driving transistor and a second driving voltage terminal to emit light from the light emitting element emits light; and a panel driver configured to supply the first driving voltage and the data voltage to the plurality of pixels at every data charging period, and simultaneously change a level of the first driving voltage or second driving voltage supplied to the plurality of pixels at every data charging period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the present embodiments and are incorporated in and constitute a part of this application, illustrate embodiments in accordance with the invention. In the drawings.

DETAILED DESCRIPTION OF THE INVENTION

Figure 1:
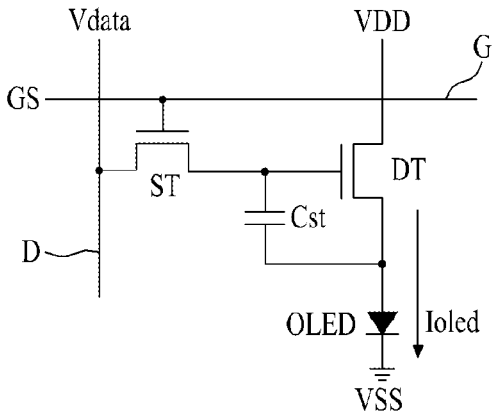
FIG. 1 Related Art
FIG. 1 is a circuit diagram for describing a pixel structure of a general organic light emitting display device of the related art.

In the specification, in adding reference numerals for elements in each drawing, it should be noted that like reference numerals may be used to indicate like elements.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Hereinafter, present embodiments of an organic light emitting display device will be described in detail with reference to the accompanying drawings.

Figure 2:
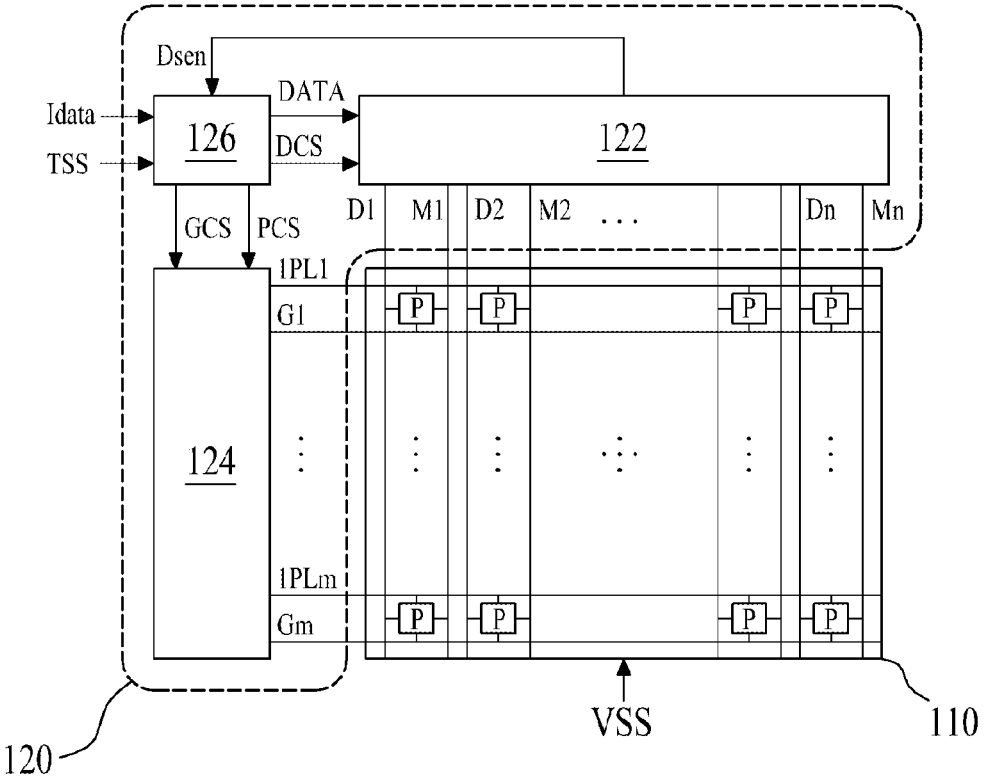
FIG. 2 is a diagram for describing an organic light emitting display device according to a first embodiment.
Figure 3:
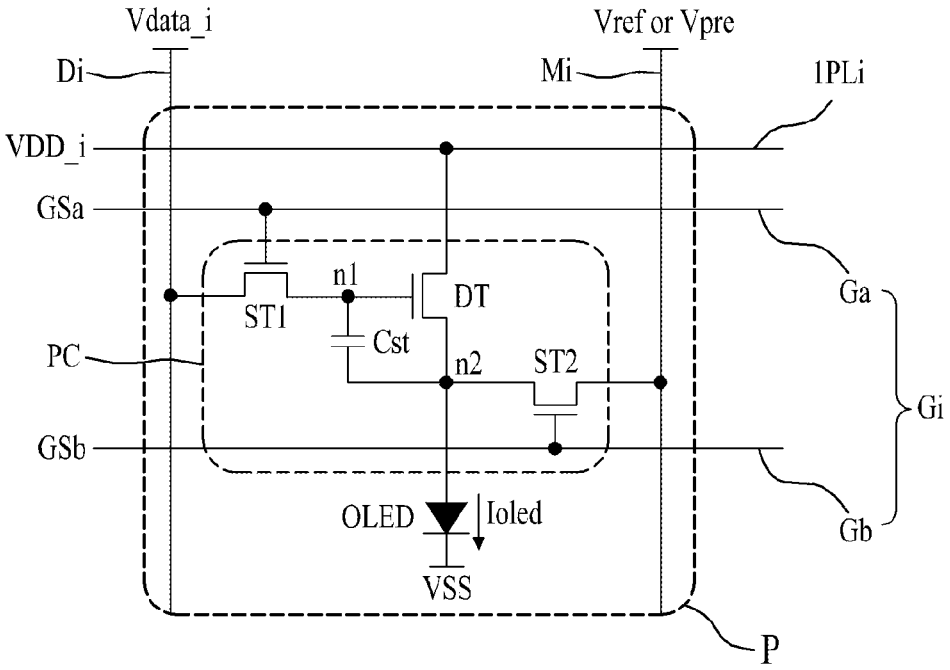
FIG. 3 is a circuit diagram for describing a pixel structure of FIG. 2.

FIG. 2 is a diagram for describing an organic light emitting display device according to a first embodiment, and FIG. 3 is a circuit diagram for describing a pixel structure of FIG. 2.

With reference to FIGS. 2 and 3, the organic light emitting display device according to the first embodiment may include a display panel 110 and a panel driver 120.

The display panel 110 may include a plurality of pixels P that are selectively driven in a data charging period, in which a difference voltage "Vdata−Vref" between a data voltage Vdata (shown in FIG. 3 as Vdata_i, which is the data voltage Vdata supplied to an ith data line Di) and a reference voltage Vref is charged into a capacitor Cst connected between a gate and source of a driving transistor DT receiving a first driving voltage VDD_i, and a light emitting period in which an light emitting element OLED emits light with a data current Ioled that flows from a first driving voltage VDD_i terminal to a second driving voltage VSS terminal through a driving transistor DT according to the charged voltage of the capacitor Cst.

Each of the plurality of pixels P may be formed as one of red, green, blue, and white. Therefore, a unit pixel for displaying one image may be configured with an adjacent red pixel, green pixel, and blue pixel, or may be configured with an adjacent red pixel, green pixel, blue pixel, and white pixel.

The plurality of pixels P may be respectively formed in a plurality of pixel areas defined in the display panel 110. To this end, the display panel 110 includes a plurality of gate lines groups G1 to Gm, a plurality of data lines D1 to Dn, a plurality of dummy lines M1 to Mn, and a plurality of first driving power lines 1PL1 to 1PLm. Here, the plurality of gate lines groups G1 to Gm and the plurality of data lines D1 to Dn are formed to define the plurality of pixels areas.

The plurality of gate line groups G1 to Gm may be formed in parallel and in a first direction, e.g., a width direction, of the display panel 110. Each of the plurality of gate line groups G1 to Gm may include first and second gate lines Ga and Gb. The panel driver 120 may separately supply a gate signal to the first and second gate lines Ga and Gb of each of the plurality of gate line groups G1 to Gm.

The plurality of data lines D1 to Dn may be formed in parallel and in a second direction, e.g., a length direction, of the display panel 110, to intersect the plurality of gate line groups G1 to Gm. The panel driver 120 may supply data voltages Vdata to the plurality of data lines D1 to Dn, respectively. A data voltage Vdata to be supplied to each of the plurality of pixels P may have a voltage level to which a compensation voltage corresponding to a threshold voltage of the driving transistor DT of a corresponding pixel P is added. The the compensation voltage will be described in more detail below.

The plurality of dummy lines M1 to Mn may be formed in parallel with the plurality of data lines D1 to Dn. The panel driver 120 may selectively supply the reference voltage Vref and a pre-charging voltage Vpre to the plurality of dummy lines M1 to Mn. In this case, the reference voltage Vref is supplied to the plurality of dummy lines M1 to Mn during the data charging period of each pixel P, and the pre-charging voltage Vpre is supplied to the plurality of dummy lines M1 to Mn during an initialization period of the capacitor Cst in a separate detection period in which a threshold voltage/mobility of the driving transistor DT of each pixel P is detected. The pre-charging voltage Vpre will be described in more detail below.

The plurality of first driving power lines 1PL1 to 1PLm may be formed in parallel with the plurality of gate line groups G1 to Gm. The panel driver 120 may supply a plurality of the first driving voltages VDD_i having different levels to the plurality of first driving power lines 1PL1 to 1PLm at every data charging period and light emitting period. That is, the first driving voltages VDD_i having a first level may be supplied to the plurality of first driving power lines 1PL1 to 1PLm at every data charging period, and the first driving voltages VDD_i having a second level higher than the first level may be supplied to the plurality of first driving power lines 1PL1 to 1PLm at every light emitting period.

Each of the plurality of pixels P includes may include a pixel circuit PC that charges the capacitor Cst with the difference voltage "Vdata−Vref" between the data voltage Vdata and the reference voltage Vref during the data charging period, and that supplies the data current Ioled to the light emitting element OLED according to the charged voltage of the capacitor Cst during the light emitting period.

The pixel circuit PC of each pixel P may include a first switching transistor ST1, a second switching transistor ST2, the driving transistor DT, and the capacitor Cst. Here, each of the transistors ST1, ST2 and DT may be an N-type thin film transistor (TFT), for example, an a-Si TFT, a poly-Si TFT, an oxide TFT, or an organic TFT.

The first switching transistor ST1 may include a gate electrode connected to a first gate line Ga, a first electrode connected to an adjacent data line Di, and a second electrode connected to a first node n1 that is a gate electrode of the driving transistor DT. The first switching transistor ST1 may supply the data voltage Vdata (e.g., Vdata_i shown in FIG. 3), supplied to the data line Di, to the first node n1 (i.e., the gate electrode of the driving transistor DT) according to a level of a gate-on voltage supplied to the first gate line Ga.

The second switching transistor ST2 may include a gate electrode connected to a second gate line Gb, a first electrode connected to an adjacent dummy line Mi, and a second electrode connected to a second node n2 that may be a source electrode of the driving transistor DT. The second switching transistor ST2 may supply the reference voltage Vref (or the pre-charging voltage Vpre), supplied to the dummy line Mi, to the second node n2 (e.g., the source electrode of the driving transistor DT) according to a level of the gate-on voltage supplied to the second gate line Gb.

The capacitor Cst may include first and second electrodes respectively connected to the first and second nodes n1 and n2 (e.g., the gate and source electrode of the driving transistor DT). The capacitor Cst is charged with a difference voltage between voltages respectively supplied to the first and second nodes n1 and n2, and is turned on according to the charged voltage.

The driving transistor DT may include: (a) the gate electrode connected to the second electrode of the first switching transistor ST1 and the first electrode of the capacitor Cst in common, (b) the source electrode connected to the first electrode of the second switching transistor ST2, a second electrode of the capacitor Cst, and the light emitting element OLED in common, and (c) the drain electrode connected to the first driving power line 1PLi. The driving transistor DT may be turned on with the voltage of the capacitor Cst at every light emitting period, and may control an amount of current which flows to the light emitting element OLED with the first driving voltage VDD_i.

The light emitting element OLED may emit light with the data current Ioled supplied from the pixel circuit PC, e.g., the driving transistor DT, to emit single-color light having a brightness corresponding to the data current Ioled. To this end, the light emitting element OLED includes an anode (not shown) connected to the second node n2 of the pixel circuit PC, an organic layer (not shown) formed on the anode, and a cathode that is formed on the organic layer to receive the second driving voltage VSS. Here, the organic layer may be formed to have a structure of a hole transport layer/organic emission layer/electron transport layer or a structure of a hole injection layer/hole transport layer/organic emission layer/electron transport layer/electron injection layer. The organic layer may further include a function layer for enhancing the emission efficiency and/or service life of the organic emission layer.

The second driving voltage VSS may be supplied to a cathode of the light emitting element OLED through a second driving power line (not shown) that is formed in a line shape.

The panel driver 120 may include a column driver 122, a row driver 124, and a timing controller 126.

The column driver 122 may be connected to the plurality of data lines D1 to Dn, and may operate in a display mode or a detection mode according to a mode controlled by the timing controller 126. Here, the display mode may allow the plurality of pixels to be driven in the data charging period and the light emitting period, and the detection mode may allow the plurality of pixels to be driven in an initialization period, a detection voltage charging period, and a voltage detecting period.

In the display mode, the column driver 122 may supply the reference voltage Vref to each of the dummy lines M1 to Mn at every data charging period of a corresponding pixel P, and may simultaneously convert pixel data DATA supplied from the timing controller 126 into data voltages Vdata to respectively supply the data voltages Vdata to the data lines D1 to Dn.

In the detection mode, the column driver 122 may supply the pre-charging voltage Vpre to the dummy lines M1 to Mn, and may simultaneously convert pixel data DATA for detection supplied from the timing controller 126 into data voltages Vdata for detection to respectively supply the detection data voltages Vdata to the data lines D1 to Dn at every detection period. Subsequently, the column driver 122 may float the dummy lines M1 to Mn such that voltages, corresponding to currents which respectively flow in the driving transistors DT of the pixels P with the pre-charging voltage Vpre and the data voltages Vdata for detection, are charged into the respective dummy lines M1 to Mn. Then, the column driver 122 may detect the voltages charged into the respective dummy lines M1 to Mn, may convert each of the detected voltages into detection data Dsen corresponding to a threshold voltage/mobility of the driving transistor DT of a corresponding pixel P, and may supply the detection data Dsen to the timing controller 126.

The row driver 124 may be connected to the plurality of gate line groups G1 to Gm and the plurality of first driving power lines 1PL1 to 1PLm, and may operate in the display mode or the detection mode according to a mode controlled by the timing controller 126.

In the display mode, the row driver 124 may supply a group gate signal having a gate-on voltage level to the gate line groups G1 to Gm and may simultaneously supply the first driving voltage VDD_i (having a first voltage level) to the first driving power lines 1PL1 to 1PLm at every data charging period of each pixel P. In the display mode, the row driver 124 may also supply the group gate signal having a gate-off voltage level to the gate line groups G1 to Gm and may simultaneously supply the first driving voltage VDD_i (having a second voltage level different from the first voltage level) to the first driving power lines 1PL1 to 1PLm at every light emitting period of each pixel P. Here, the first voltage level may be lower than the second voltage level, and may be equal to or lower than the reference voltage.

Also in the display mode, the row driver 124 may float a corresponding first driving power line during the data charging period of each pixel P.

In the detection mode, the row driver 124 may supply the group gate signal having the gate-on voltage level to the gate line groups G1 to Gm and may simultaneously supply the first driving voltage VDD_i having the first voltage level to the first driving power lines 1PL1 to 1PLm at every initialization period and detection voltage charging period of each pixel P. In the detection mode, the row driver 124 may also supply the group gate signal having the gate-off voltage level and a data-on voltage level to the gate line groups G1 to Gm and may simultaneously supply the first driving voltage VDD_i having the second voltage level to the first driving power lines 1PL1 to 1PLm at every voltage detecting period of each pixel P.

Also in the detection mode, the row driver 124 may float a corresponding first driving power line during the initialization period of each pixel P.

The timing controller 126 may operate the column driver 122 and the row driver 124 in the display mode, and at a user's setting time or at a predetermined time for detecting the threshold voltage/mobility of the driving transistor DT, the timing controller 126 may operate the column driver 122 and the row driver 124 in the detection mode.

The detection mode may be performed at an initialization driving time of the display panel 110, an end time after the display panel 110 is driven for a long time, and/or a blank interval of a frame for displaying an image in the display panel 110. In the detection mode during the initialization driving time of the display panel 110 or the end time after the display panel 110 is driven for a long time, the timing controller 126 may detect the threshold voltages and mobility of the driving transistors DT of all the pixels P of the display panel 110 during one frame. In the detection mode during the blank interval, the timing controller 126 may detect the threshold voltages and mobility of the driving transistors DT of a plurality of pixels P formed on one horizontal line at every blank interval. In this way, the timing controller 126 detects the threshold voltages and mobility of the driving transistors DT of all the pixels P of the display panel 110 during the blank intervals of a plurality of frames.

In the display mode, the timing controller 126 may generate a data control signal DCS, a gate control signal GCS, and a power control signal PCS for driving the plurality of pixels P connected to the respective gate line groups G1 to Gm in the data charging period and the light emitting period in units of one horizontal period, on the basis of a timing sync signal TSS which is inputted from the outside, for example, from a system body (not shown) or a graphics card (not shown). The timing controller 126 may control the driving of each of the column driver 122 and the row driver 124 in the display mode by using the data control signal DCS, the gate control signal GCS, and the power control signal PCS.

In the detection mode, the timing controller 126 may generate the data control signal DCS, the gate control signal GCS, and the power control signal PCS for detecting the threshold voltages and mobility of the driving transistors DT of the respective pixels P connected to the gate line groups G1 to Gm in units of one horizontal period, on the basis of the timing sync signal TSS. The timing controller 126 may control the driving of the column driver 122 and the row driver 124 in the detection mode by using the data control signal DCS, the gate control signal GCS, and the power control signal PCS.

The timing sync signal TSS may include a vertical sync signal, a horizontal sync signal, a data enable signal, and a clock. The gate control signal GCS may include a gate start signal and a plurality of clock signals, and the data control signal DCS may include a data start signal, a data shift signal, and a data output signal. The power control signal PCS may include a power start signal and a power shift signal. However, the power control signal PCS may not be provided depending on a circuit configuration of the row driver 124 that supplies the first driving voltage VDD_i to the first driving power lines 1PL1 to 1PLm.

In the detection mode, the timing controller 126 may generate data for detection, and may supply the detection data to the column driver 122.

In the display mode, the timing controller 126 may correct input data Idata inputted from the outside on the basis of the detection data Dsen of the respective pixels P, which is supplied from the column driver 122 in the detection mode, to generate pixel data DATA, and may supply the generated pixel data DATA to the column driver 122. Here, the pixel data DATA to be supplied to the respective pixels P has a voltage level in which a compensation voltage for compensating for the threshold voltage/mobility of the driving transistor DT of a corresponding pixel P is reflected.

The input data Idata may include red (R), green (G), and blue (B) input data to be supplied to one unit pixel. When the unit pixel is composed of a red pixel, a green pixel, and a blue pixel, one piece of pixel data DATA may be red, green, or blue data. On the other hand, when the unit pixel is composed of a red pixel, a green pixel, a blue pixel, and a white pixel, one piece of pixel data DATA may be red, green, blue, or white data.

In FIG. 2, the column driver 122 is illustrated as being connected to one side of the plurality of data lines D1 to Dn, but it may be connected to both sides of each of the plurality of data lines D1 to Dn for minimizing a drop of data voltages Vdata without being limited thereto. Likewise, the row driver 124 may also be connected to both sides of each of the plurality of gate line groups G1 to Gm and the plurality of first driving power lines 1PL1 to 1PLm, for minimizing a voltage drop of the gate signal and a drop of the first driving voltage.

Figure 4:
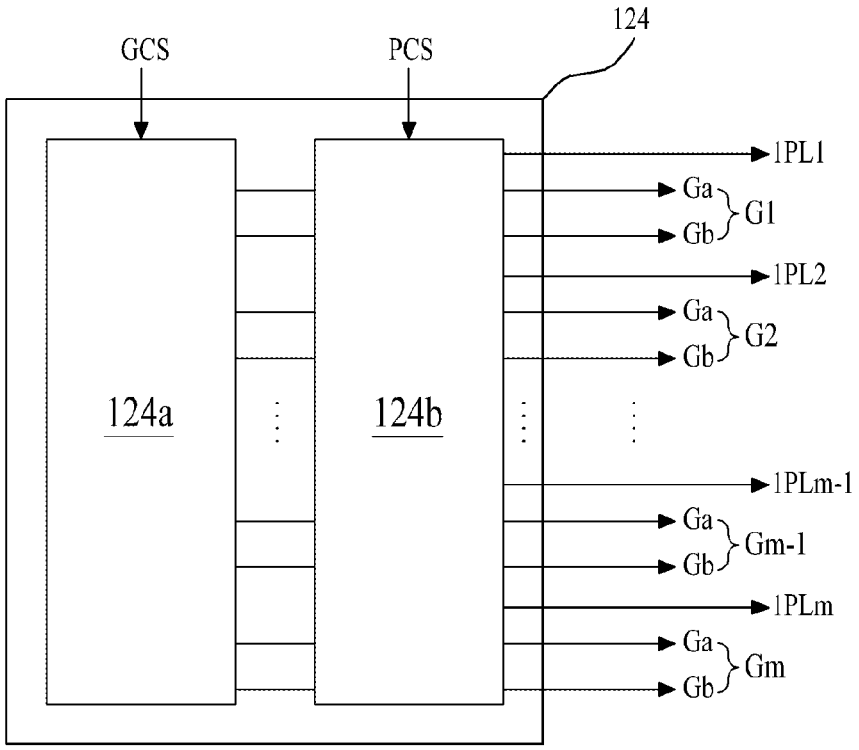
FIG. 4 is a block diagram for describing a row driver of FIG. 2.
Figure 5:
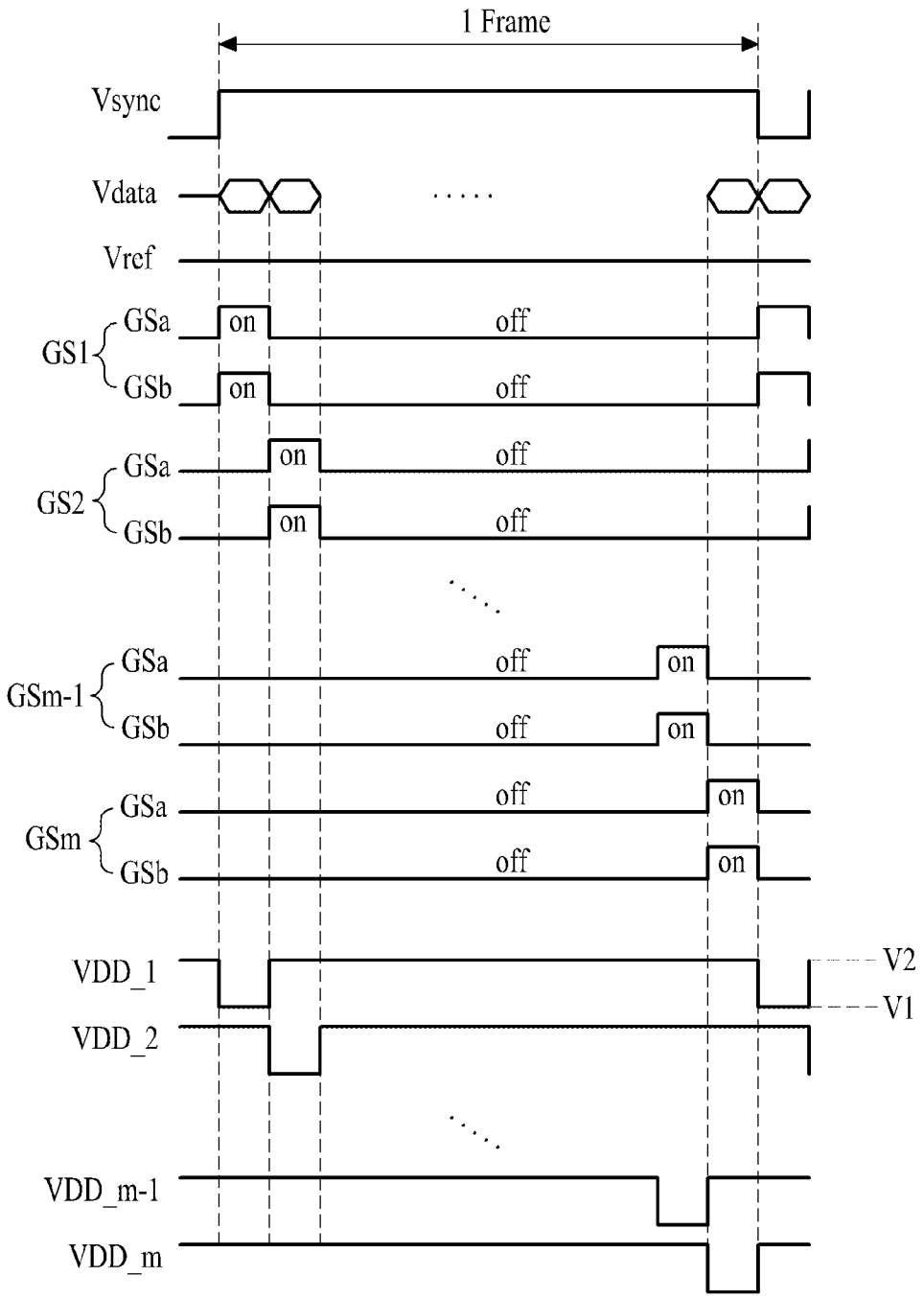
FIG. 5 is a waveform diagram showing output signals of the row driver in a display mode.

FIG. 4 is a block diagram for describing the row driver of FIG. 2, and FIG. 5 is a waveform diagram showing output signals of the row driver in the display mode.

With reference to FIGS. 2, 4, and 5, the row driver 124 may include a gate driver 124*a* and a power driver 124*b*.

The gate driver 124*a* may generate a plurality of group gate signals GS1 to GSm, having the gate-on voltage level, and which are sequentially shifted at every one horizontal period according to the gate control signal GCS supplied from the timing controller 126, and may sequentially supply the plurality of group gate signals GS1 to GSm to the plurality of gate line groups G1 to Gm. Here, each of the plurality of group gate signals GS1 to GSm includes first and second gate signals GSa and GSb that are respectively supplied to the first and second gate lines Ga and Gb of a corresponding gate line group. The first and second gate signals GSa and GSb may have the gate-on voltage level during the data charging period of each pixel P, and may have the gate-off voltage level during the light emitting period of each pixel P. The gate driver 124*a* may be a shift register that generates the group gate signals GS1 to GSm according to the gate control signal GCS.

The gate driver 124*a* may generate the first and second gate signals GSa and GSb to have the gate-on voltage levels of different widths (e.g., different on times), and/or may generate the first and second gate signals GSa and GSb in order for adjacent gate group signals to overlap each other during one horizontal period.

The power driver 124*b* may generate a plurality of first driving voltages VDD_1 to VDD_m, having a first voltage level V1, which may be sequentially shifted at every one horizontal period so as to overlap the first gate signal GSa having the gate-on voltage level according to the power control signal PCS supplied from the timing controller 126, and may sequentially supply the plurality of first driving voltages VDD_1 to VDD_m to the plurality of first driving power lines 1PL1 to 1PLm, respectively. Here, each of the plurality of first driving power lines 1PL1 to 1PLm has the first voltage level V1 during the data charging period of each pixel P, and has a second voltage level V2 during the light emitting period of each pixel P. The power driver 124*b* may be a shift register that generates the first driving voltages VDD_1 to VDD_m according to the power control signal PCS.

The power driver 124*b* may generate the first driving voltages VDD_1 to VDD_m having the first voltage level V1 or the second voltage level V2 according to the respective group gate signals GS1 to GSm, which are outputted from the gate driver 124*a*, instead of the power control signal PCS supplied from the timing controller 126, and may sequentially supply the first driving voltages VDD_1 to VDD_m to the plurality of first driving power lines 1PL1 to 1PLm, respectively. In this case, the power driver 124*b* may include a plurality of first driving power selectors (not shown) that output the first driving voltages VDD_1 to VDD_m having the first voltage level V1 according to the gate-on voltage level of the first gate signal GSa, and output the first driving voltages VDD_1 to VDD_m having the second voltage level V2 according to the gate-off voltage level of the first gate signal GSa.

The power driver 124*b* may float a corresponding first driving power line according to the power control signal PCS and the first gate signal GSa during the data charging period of each pixel P, and may allow the first voltage level V1 to have a broader width than the first and second gate signals The row driver 124 including the gate driver 124*a* and the power driver 124*b* may be manufactured in an integrated circuit (IC) type, and may be mounted on a flexible circuit film (not shown) adhered to the display panel 110 or on the display panel 110. Alternatively, the row driver 124 may be directly provided in a non-display area of the display panel 110 in a process of manufacturing a TFT of each pixel P.

In the detection mode, the gate driver 124*a* may generate the group gate signals GS1 to GSm, which may each include the first and second gate signals GSa and GSb having the gate-on voltage level, at every initialization period and detection voltage charging period of each pixel P to respectively supply the group gate signals GS1 to GSm to the grate line groups G1 to Gm, and may generate the group gate signals GS1 to GSm, which may each include the first gate signal GSa having the gate-off voltage level and the second gate signal GSb having the gate-on voltage level, at every voltage detecting period of each pixel P to respectively supply the group gate signals GS1 to GSm to the grate line groups G1 to Gm.

In the detection mode, during only the initialization period of each pixel P, the first driving power driver 124*a* may supply the first driving voltage VDD_i having the first voltage level to the first driving power lines 1PL1 to 1PLm, and float a corresponding first driving power line.

Figure 6:
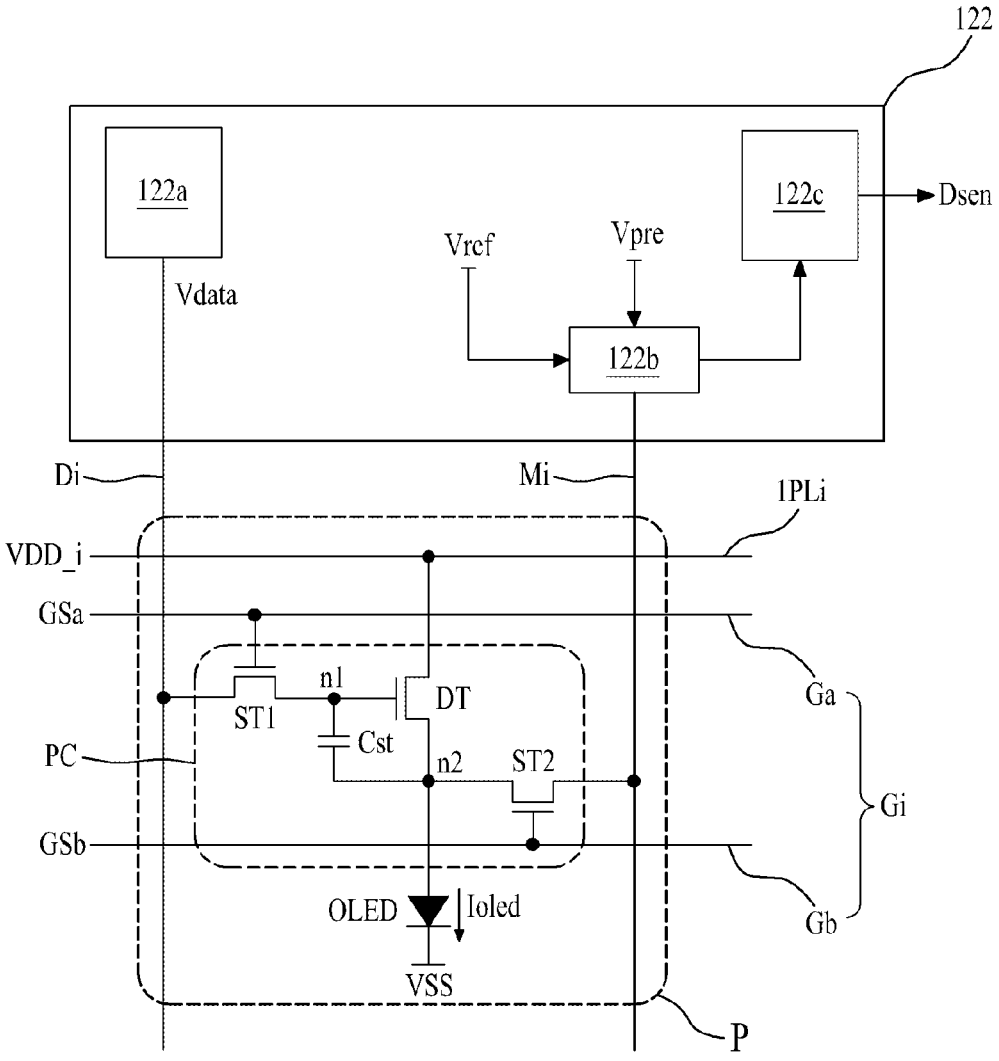
FIG. 6 is a diagram for describing a column driver of FIG. 2.

FIG. 6 is a diagram for describing the column driver of FIG. 2.

With reference to FIGS. 2 and 6, the column driver 122 includes a data voltage generator 122*a*, a switching unit 122*b*, and a detection data generator 122*c*.

The data voltage generator 122*a* may convert the pixel data DATA inputted thereto into the data voltage Vdata, and may supply the data voltage Vdata to the data line Di. To this end, the data voltage generator 122*a* may include a shift register that generates a sampling signal, a latch that latches the pixel data DATA according to the sampling signal, a grayscale voltage generator that generates a plurality of grayscale voltages by using a plurality of reference gamma voltages, a digital-to-analog converter (DAC) that selects and outputs a grayscale voltage, corresponding to the latched pixel data DATA among the plurality of grayscale voltages, as the data voltage Vdata, and an output unit that outputs the data voltage Vdata.

The switching unit 122*b* may supply the reference voltage Vref or the pre-charging voltage Vpre to the dummy line Mi, float the dummy line Mi, and connect the dummy line Mi to the detection data generator 122*c*. For example, the switching unit 122*b* may supply the reference voltage Vref to the dummy line Mi according to control by the timing controller 126 based on the display mode. On the other hand, the switching unit 122*b* may supply the pre-charging voltage Vpre to the dummy line Mi, float the dummy line Mi, and connect the dummy line Mi to the detection data generator 122*c*, according to control by the timing controller 126 based on the detection mode. For example, the switching unit 122*b* may include a de-multiplexer.

When the detection data generator 122*c* is connected to the dummy line Mi by the switching unit 122*b*, the detection data generator 122*c* may detect a voltage charged into the dummy line Mi, generate digital detection data Dsen corresponding to the detected voltage Vsen, and supply the digital detection data Dsen to the timing controller 126. Here, as expressed in the following Equation (1), the voltage Vsen detected from the dummy line Mi may be decided as a ratio of a current "$i_{DT}$" (current flowing in the driving transistor DT based on a time change "dt") and a capacitance "$C_M$" of the dummy line Mi.

$$Vsen = \frac{i_{DT}}{C_M} dt \quad (1)$$

The detection data Dsen may be composed of information corresponding to the threshold voltage/mobility of the driving transistor DT of each pixel P.

Figure 7:
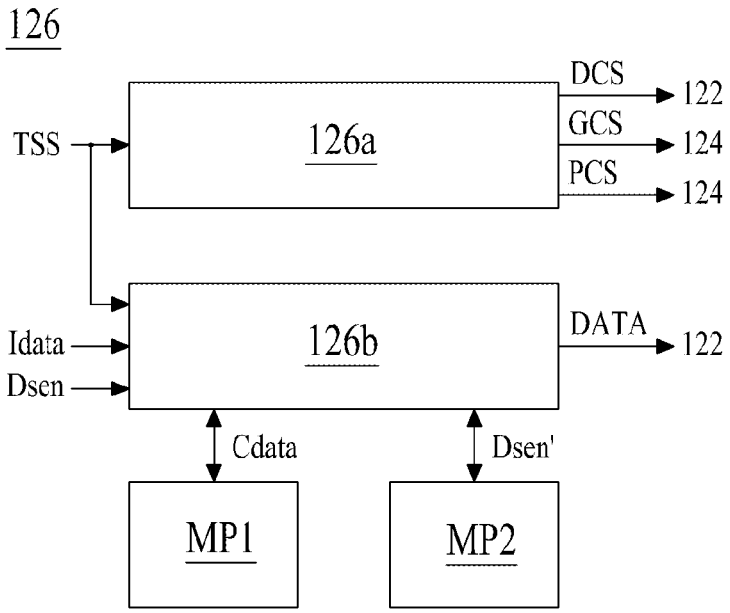
FIG. 7 is a diagram for describing a timing controller of FIG. 2.

FIG. 7 is a diagram for describing the timing controller of FIG. 2.

With reference to FIGS. 2 and 7, the timing controller 126 may include a control signal generator 126*a*, first and second memory parts MP and MP2, and a data processor 126*b*.

The control signal generator 126*a* may generate the data control signal DCS, the gate control signal GCS, and the power control signal PCS, which correspond to the display mode or the detection mode on the basis of the timing sync signal TSS inputted from the outside, supply the data control signal DCS to the column driver 122, and simultaneously supply the gate control signal GCS and the power control signal PCS to the row driver 124. However, here, as described above, the control signal generator 126*a* may not generate the power control signal PCS.

Compensation data Cdata for each pixel P of the display panel 110 may be mapped in the first memory part MP1 in correspondence with a pixel arrangement structure. The compensation data Cdata may be generated by an optical brightness measuring method performed by an optical brightness measuring apparatus. A brightness of each pixel P may be measured by displaying the same or similar test pattern in each pixel P of the display panel 110 according to the present embodiments, and a compensation value for each pixel that is set for compensating for a deviation of reference brightness values based on the test pattern and the measured brightness value of each pixel P may be the compensation data Cdata. Here, the compensation data Cdata stored in the first memory part MP1 may not be updated.

Initial detection data Dsen' (which may be detected by the column driver 122 according to the detection mode of the present embodiments) for each pixel P is mapped in the second memory part MP2 in correspondence with the pixel arrangement structure. The initial detection data Dsen' may be a voltage value corresponding to the threshold voltage/mobility (which may be detected by performing the detection mode at a releasing time or an initial driving time of the display panel 110) of the driving transistor DT of each of all the pixels P of the display panel 110.

The data processor 126*b* may compare the detection data (supplied from the column driver 122) of each pixel P and the initial detection data Dsen' (stored in the second memory part MP2) of each pixel P according to the detection mode, and when a deviation therebetween is within a reference deviation range, the data processor 126*b* may correct the input data Idata inputted from the outside on the basis of the compensation data Cdata of each pixel P stored in the first memory part MP1 to generate the pixel data DATA, and may supply the generated pixel data DATA to the column driver 122. On the other hand, when the deviation of the detection data Dsen and initial detection data Dsen' of each pixel P exceeds the reference deviation range, the data processor 126*b* may correct the input data Idata on the basis of the deviation of the detection data Dsen and initial detection data Dsen' of each pixel P and the compensation data Cdata of each pixel P to generate the pixel data DATA, and supply the generated pixel data DATA to the column driver 122. The data processor 126*b* may estimate an amount of current changed by a change in threshold voltage/mobility of the driving transistor DT of each pixel P on the basis of the detection data Dsen to decide a compensation value, and correct the input data Idata according to the compensation value to generate the pixel data DATA. Therefore, the light emitting element OLED of each pixel P emits light at a brightness corresponding to initial input data Idata with the data voltage Vdata in which a change in threshold voltage/mobility of the driving transistor DT has been compensated for according to the pixel data DATA.

Figure 8:
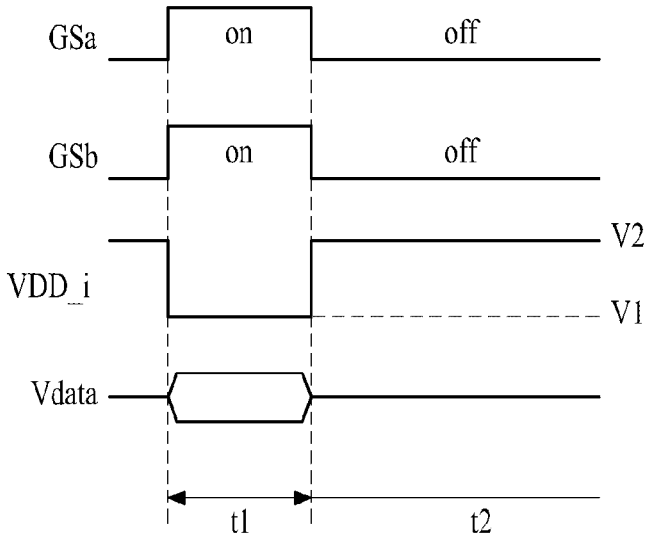
FIG. 8 is a waveform diagram showing a plurality of driving waveforms in a display mode of an organic light emitting display device according to the first embodiment.

FIG. 8 is a waveform diagram showing a plurality of driving waveforms in the display mode of an organic light emitting display device according to the first embodiment.

An operation of one pixel connected to an ith gate line group Gi in the display mode will now be described with reference to FIGS. 2, 6, and 8.

First, the timing controller 126 may correct the input data Idata on the basis of the detection data Dsen of a corresponding pixel P supplied from the column driver 122 to generate the pixel data DATA. The timing controller 126 may control a driving timing of each of the row driver 124 and column driver 122 to drive the pixel P in a data charging period t1 and a light emitting period t2.

In the data charging period t1, by a driving of the row driver 124, the first and second gate signals GSa and GSb having the gate-on voltage level may be supplied to the first and second gate lines Ga and Gb of the ith gate line Gi and simultaneously the first driving voltage VDD_i having the first voltage level V1 may be supplied to an ith-order first driving power line iPLi. Also in the data charging period t1, by a driving of the column driver 122, the data voltage Vdata generated by converting the pixel data DATA may be supplied to the data line Di and simultaneously the reference voltage Vref may be supplied to the dummy line Mi. Therefore, the first and second switching transistors ST1 and ST2 of the pixel P are respectively turned on by the first and second gate signals GSa and GSb, and thus, the data voltage Vdata is supplied to the first node n1, and a voltage of the second node n2 is initialized to the reference voltage Vref, whereby the difference voltage "Vdata−Vref" between the data voltage Vdata and the reference voltage Vref is charged into the capacitor Cst.

As described above, the present embodiments may supply the first driving voltage VDD_i having the first voltage level V1 to the ith-order first driving power line 1PLi during the data charging period t1, and thus prevent a current from flowing in the dummy line Mi during the data charging period t1. For example, when the first driving voltage VDD_i has the second voltage level V2 higher than the first voltage level V1 during the data charging period t1, a current flows in the driving transistor DT with a gate-source voltage "Vgs" of the driving transistor DT and flows to the dummy line Mi, and thus, the reference voltage Vref rises, whereupon the gate-source voltage "Vgs" (i.e., a voltage charged into the capacitor Cst) of the driving transistor DT has a level lower than the desired difference voltage "Vdata−Vref" between the data voltage Vdata and the reference voltage Vref. For this reason, a desired brightness may not be realized. To solve such a problem, the the first driving voltage VDD_i having the first voltage level V1, which is lower than the second voltage level V2 and equal to or lower than the reference voltage Vref, is supplied to the first driving power line 1PLi during the data charging period t1, and this prevents the reference voltage Vref from rising, thereby enabling the desired difference voltage "Vdata−Vref" between the data voltage Vdata and the reference voltage Vref to be charged into the capacitor Cst.

Subsequently, in the light emitting period t2, the first and second gate signals GSa and GSb having the gate-off voltage level may be respectively supplied to the first and second gate lines Ga and Gb of the ith gate line group Gi, and simultaneously the first driving voltage VDD_i having the second voltage level V2 may be supplied to the ith-order first driving power line 1PLi, by a driving of the row driver 124. Therefore, in the light emitting period t2, the first and second switching transistors ST1 and ST2 of the pixel P may be respectively turned on by the first and second gate signals GSa and GSb, and thus, the driving transistor DT is turned on with the voltage charged into the capacitor Cst. Therefore, as expressed in the following Equation (2), the turned-on driving transistor DT may supply a data current Ioled, which is decided based on the difference voltage "Vdata−Vref" between the data voltage Vdata and the reference voltage Vref, to the light emitting element OLED, and thus, the light emitting element OLED emits light in proportion to the data current Ioled flowing to the second driving voltage VSS terminal with the first driving voltage VDD_i having the second voltage level V2. That is, in the light emitting period t2, when the first and second switching transistors ST1 and ST2 are turned off, the first driving voltage VDD_i supplied to the first driving power line 1PLi rises to the second voltage level V2 to cause a current to flow in the driving transistor DT, the light emitting element OLED starts to emit light in proportion to the current to cause the voltage of the second node n2 to rise, a voltage of the first node n1 rises by the rising voltage of the second node n2 by the capacitor Cst, and the gate-source voltage "Vgs" of the driving transistor DT is continuously held with the voltage of the capacitor Cst, thereby enabling the light emitting element OLED to continuously emit light until a next data charging period t1.

$$\text{Ioled}=k(V\text{data}-V\text{ref})^2 \quad (2)$$

where k denotes a proportional constant, and is a value that is decided based on a structure and physical characteristic of the driving transistor DT. k may be decided based on the mobility of the driving transistor DT and a ratio "W/L" of a channel width "W" and channel length "L" of the driving transistor DT.

In Equation (2), the data current Idled which flows in the light emitting element OLED during the light emitting period t2 is decided based on a difference between the data voltage Vdata and the reference voltage Vref independently from a change in threshold voltage/mobility of the driving transistor DT, due to the data voltage Vdata generated by converting the pixel data DATA in which the change in threshold voltage/mobility of the driving transistor DT has been compensated for.

Therefore, in the display mode, the organic light emitting display device according to the first embodiment may drive each pixel P with the pixel data DATA in which the detection data Dsen corresponding to the threshold voltage/mobility of the driving transistor DT of the pixel P is reflected, thereby compensating for a threshold voltage deviation of the driving transistor DT of the pixel P at intervals or in real time.

Figure 9:
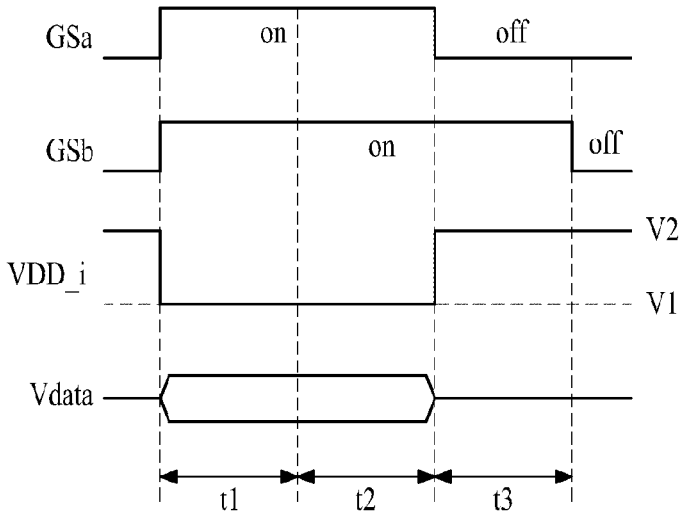
FIG. 9 is a waveform diagram showing a plurality of driving waveforms in a detection mode of the organic light emitting display device according to the first embodiment.

FIG. 9 is a waveform diagram showing a plurality of driving waveforms in the detection mode of the organic light emitting display device according to the first embodiment.

An operation of one pixel connected to the ith gate line group Gi in the detection mode will now be described with reference to FIGS. 2, 6, and 9.

First, in the detection mode, the timing controller 126 may control a driving timing of each of the row driver 124 and the column driver 122 to drive a corresponding pixel P in an initialization period t1, a detection voltage charging period t2, and a voltage detecting period t3.

In the initialization period t1, by a driving of the row driver 124, the first and second gate signals GSa and GSb having the gate-on voltage level may be supplied to the first and second gate lines Ga and Gb of the ith gate line Gi and simultaneously the first driving voltage VDD_i having the first voltage level V1 is supplied to an ith-order first driving power line iPLi, and by a driving of the column driver 122, the data voltage Vdata for detection generated by converting the pixel data DATA for detection may be supplied to the data line Di and simultaneously the pre-charging voltage Vpre is supplied to the dummy line Mi. Therefore, the first and second switching transistors ST1 and ST2 of the pixel P are respectively turned on by the first and second gate signals GSa and GSb, and thus, the data voltage Vdata is supplied to the first node n1, and a voltage of the second node n2 is initialized to the pre-charging voltage Vpre, whereby a difference voltage "Vdata−Vpre" between the data voltage Vdata and the pre-charging voltage Vpre is charged into the capacitor Cst.

As described above, the present embodiments supply the first driving voltage VDD_i having the first voltage level V1 to the ith-order first driving power line 1PLi during the initialization period t1, and thus prevent a current from flowing in the dummy line Mi during the initialization period t1. For example, when the first driving voltage VDD_i has the second voltage level V2 higher than the first voltage level V1 during the initialization period t1, a current flows in the driving transistor DT with a gate-source voltage "Vgs" of the driving transistor DT and flows to the dummy line Mi, and thus, the pre-charging voltage Vpre rises, whereupon the gate-source voltage "Vgs" (i.e., a voltage charged into the capacitor Cst) of the driving transistor DT has a level lower than the desired difference voltage "Vdata−Vpre" between the data voltage Vdata for detection and the pre-charging voltage Vpre. For this reason, it is unable to accurately detect a change value of the threshold voltage/mobility of the driving transistor DT of the pixel P. To solve such a problem, the present embodiments supply the first driving voltage VDD_i having the first voltage level V1, which is lower than the second voltage level V2 and equal to or lower than the pre-charging voltage Vpre, to the first driving power line 1PLi during the initialization period t1, and thus prevent the pre-charging voltage Vpre from rising, thereby enabling the desired difference voltage "Vdata−Vpre" between the data voltage Vdata and the pre-charging voltage Vpre to be charged into the capacitor Cst.

Subsequently, in the detection voltage charging period t2, the first and second gate signals GSa and GSb having the gate-on voltage level may be respectively supplied to the first and second gate lines Ga and Gb of the ith gate line group Gi, and simultaneously the first driving voltage VDD_i having the second voltage level V2 may be supplied to the ith-order first driving power line 1PLi, according to a driving of the row driver 124, and according to a driving of the column driver 122, the data voltage Vdata for detection may be continuously supplied to the data line Di and simultaneously the dummy line Mi may be floated. Therefore, in the detection voltage charging period t2, the driving transistor DT may be turned on with the data voltage Vdata for detection, and a voltage corresponding to a current flowing in the turned-on driving transistor DT may be charged into the floated dummy line Mi. At this time, a voltage corresponding to the threshold voltage of the driving transistor DT may be charged into the dummy line Mi.

Subsequently, in the voltage detecting period t3, the first gate signal GSa having the gate-off voltage level and the second gate signal GSb having the gate-on voltage level may be respectively supplied to the first and second gate lines Ga and Gb of the ith gate line group Gi, and simultaneously the first driving voltage VDD_i having the second voltage level V2 may be supplied to the ith-order first driving power line 1PLi, by a driving of the row driver 124, and the dummy line Mi may be connected to the column driver 122 by a driving of the column driver 122. Therefore, in the voltage detecting period t3, the column driver 122 may detect the voltage charged into the dummy line Mi, convert the detected voltage (i.e., the voltage corresponding to the threshold voltage of the driving transistor DT) into detection data Dsen, and supply the detection data Dsen to the timing controller 126.

The timing controller 126 may detect the threshold voltage of the driving transistor DT of the pixel P through the above-described detection mode, and then may again perform a detection mode for detecting the mobility of the driving transistor DT of the pixel P. In this case, the timing controller 126 may identically perform the above-described detection mode, for example, the timing controller 126 may control the column driver 122 and the row driver 124 such that the first switching transistor ST1 of the pixel P is turned on during only the initialization period t1 and the data voltage Vdata for detection is supplied during only the initialization period t1. Therefore, in again performing the detection mode, in the detection voltage charging period t2, the gate-source voltage of the driving transistor DT may rise according to the first switching transistor ST1 being turned off, and thus, the gate-source voltage of the driving transistor DT may be held with the voltage of the capacitor Cst, whereby a voltage corresponding to a current flowing in the driving transistor DT (i.e., a voltage corresponding to the mobility of the driving transistor DT) is charged into the floated dummy line Mi. Further, in again performing the detection mode, the column driver 122 may detect the voltage charged into the dummy line Mi (i.e., the voltage corresponding to the mobility of the driving transistor DT), convert the detected voltage into the detection data Dsen, and supply the detection data Dsen to the timing controller 126.

Therefore, the organic light emitting display device according to the first embodiment changes the first driving voltage VDD_i supplied to the first driving power line 1PLi to store a desired voltage in the capacitor Cst during the data charging period t1 of the display mode and the initialization period t1 and data charging period t1 of the detection mode, and thereby compensates for the threshold voltage of the driving transistor DT of each pixel P, thus increasing a current efficiency with respect to a data voltage and uniformizing a brightness.

In a pixel structure in which the light emitting element OLED emits light with the data current Ioled decided based on the data voltage Vdata and the reference voltage Vref, the organic light emitting display device according to the first embodiment changes the first driving voltage VDD_i when the gate-source voltage of the driving transistor DT is charged into the capacitor Cst. Therefore, the features of the organic light emitting display device according to the first embodiment may be applied to various types of pixel structures. Hereinafter, various modification examples of a pixel to which the features of the present embodiments are applied will be described.

Figure 10:
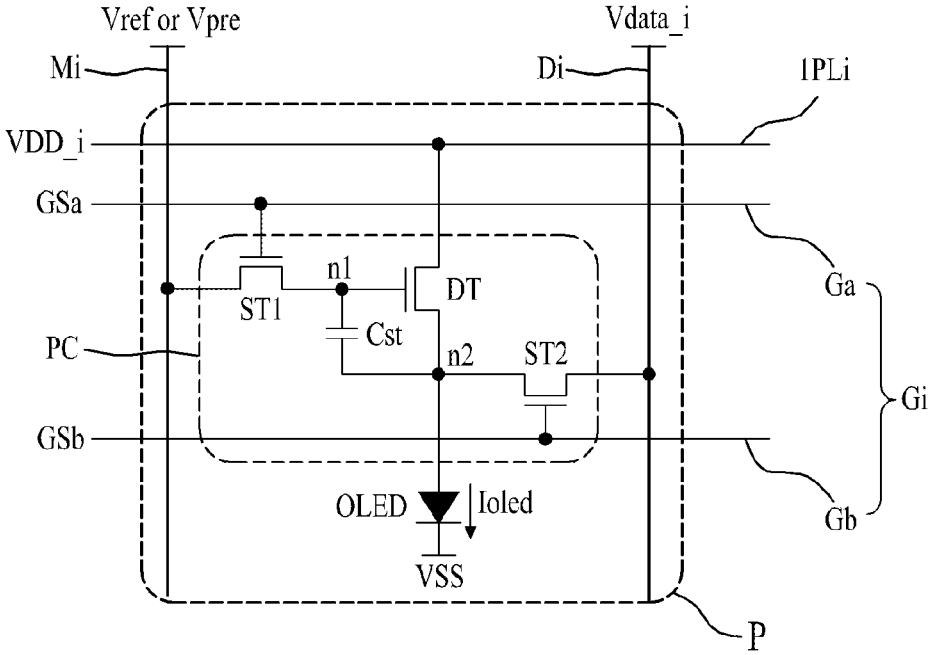
FIG. 10 is a diagram for describing a first modification example of a pixel in the organic light emitting display device according to the first embodiment.

FIG. 10 is a diagram for describing a first modification example of a pixel in the organic light emitting display device according to the first embodiment.

With reference to FIGS. 2 and 10, a pixel P according to the first modification example of the present embodiments includes a light emitting element OLED and a pixel circuit PC that includes first and second switching transistors ST1 and ST2, a driving transistor DT, and a capacitor Cst. With the exception that a first electrode of the first switching transistor ST1 is connected to a dummy line Mi and a first electrode of the second switching transistor ST2 is connected to a data line Di, the pixel P of the first modification example having the above-described configuration may be configured identically or similarly to the above-described pixel of FIG. 3. That is, the dummy line Mi and the data line Di have been changed in disposed position for facilitating a pixel arrangement structure and a line connection structure.

Therefore, in each of the data charging period and detection period of the display mode, the pixel P of the first modification example may prevent a current from flowing in the driving transistor DT when applying a data voltage Vdata to a second node n2 through the second switching transistor ST2, and thus has the same or similar effect as the above-described pixel of FIG. 3.

Figure 11:
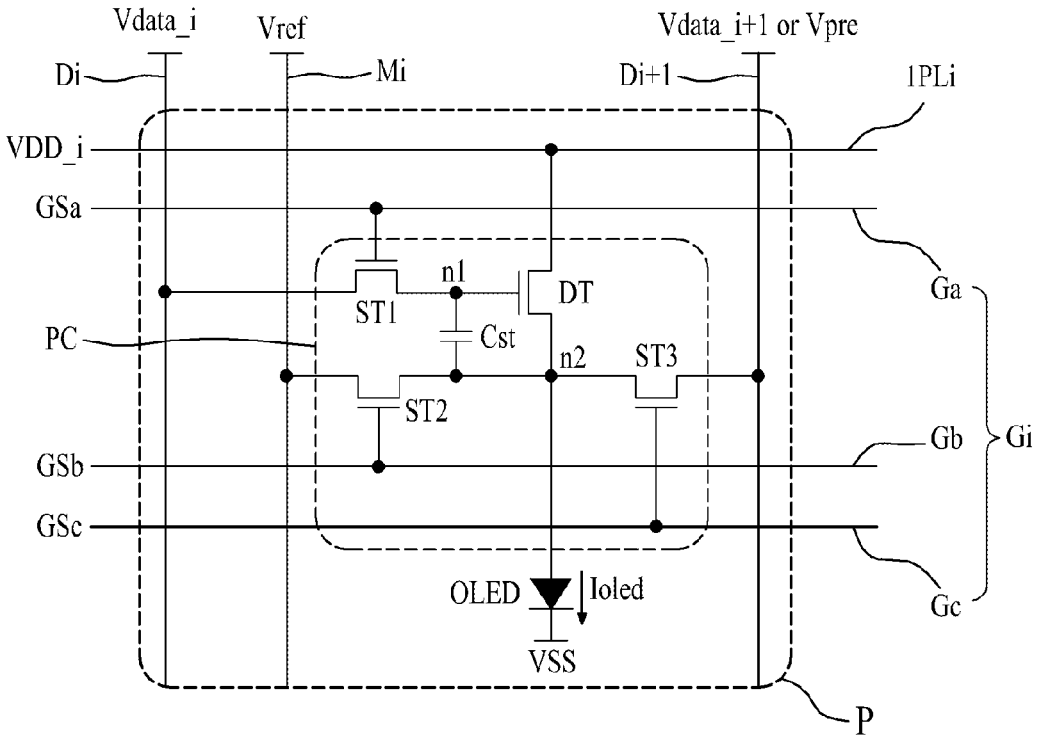
FIG. 11 is a diagram for describing a second modification example of a pixel in the organic light emitting display device according to the first embodiment.

FIG. 11 is a diagram for describing a second modification example of a pixel in the organic light emitting display device according to the first embodiment.

With reference to FIGS. 2 and 11, a pixel P according to the second modification example of the present embodiments includes a light emitting element OLED and a pixel circuit PC that includes first to third switching transistors ST1 to ST3, a driving transistor DT, and a capacitor Cst. With the exception of a third gate line Ge added to each gate line group Gi and the pixel circuit PC including the third switching transistor ST3 that is connected to a data line Di+1 of a next pixel adjacent to the pixel circuit PC and a second node n2, the pixel P of the second modification example having the above-described configuration may be configured identically or similarly to the above-described pixel of FIG. 3. Hereinafter, only different elements will be described.

First, the pixel circuit PC of the second modification example may be connected to two adjacent data lines Di and Di+1, one dummy line Mi, one first driving power line 1PLi, and first to third gate lines Ga, Gb and Gc. In the above-described display mode, the pixel circuit PC may supply a data current Ioled, which is decided based on a data voltage Vdata_i supplied to an ith data line Di and a reference voltage Vref supplied to the dummy line Mi, to a light emitting element OLED. On the other hand, in the above-described detection mode, the pixel circuit PC may charge a current, which flows in the driving transistor DT with the data voltage Vdata_i for detection and a pre-charging voltage Vpre respectively supplied to adjacent ith and i+1st data lines Di and Di+1, into the i+1st data line Di+1.

Figure 12:
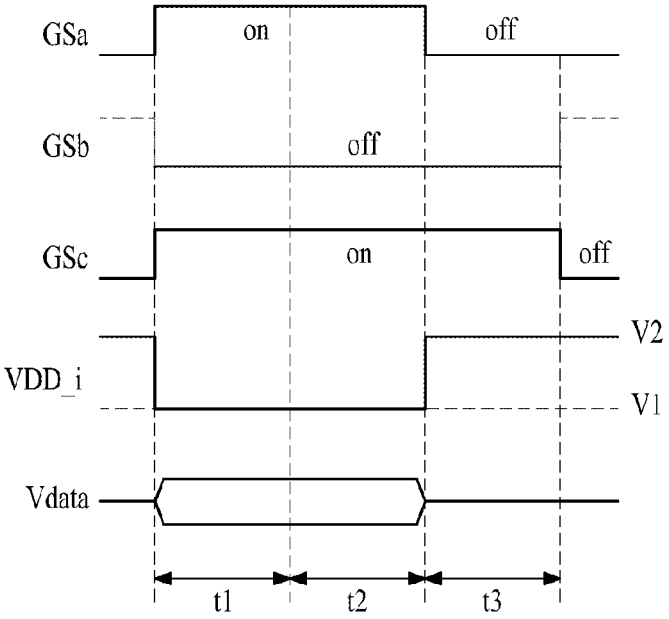
FIG. 12 is a waveform diagram showing a plurality of driving waveforms in a detection mode of a pixel of FIG. 11.

The third switching transistor ST3 may be turned off in the display mode, and as shown in FIG. 12, the third switching transistor ST3 may be turned on during only the detection mode. That is, the third switching transistor ST3 may be turned on with a third gate signal Gc (supplied from the row driver 124 to the third gate line Gc) having the gate-on voltage level during the detection mode, and thus, a voltage corresponding to the threshold voltage/mobility of the driving transistor DT is charged into the data line Di+1 of a next pixel, thereby allowing the column driver 122 to detect the charged voltage. The third switching transistor ST3 may operate in only the detection mode, and the operation of the third switching transistor ST3 may be the same as or similar to the above-described second switching transistor ST2 of FIG. 3. Thus, the description of the detection mode made above with reference to FIGS. 3 and 9 can be applied to the third switching transistor ST3.

In the display mode, a corresponding data voltage Vdata may be supplied from the column driver 122 to the adjacent ith and i+1 st data lines Di and Di+1. On the other hand, in the detection mode, the data voltage Vdata_i for detection may be supplied from the column driver 122 to the ith data line Di, and the pre-charging voltage Vpre may be supplied from the column driver 122 to the i+1st data line Di+1. At this time, in the detection mode, the data line Di+1 connected to the third switching transistor ST3 may be used as a detection line for detecting the threshold voltage/mobility of the driving transistor DT of each pixel P.

Therefore, the pixel P of the second modification example may prevent a current (flowing in the driving transistor DT) from flowing to the dummy line Mi when the reference voltage Vref is applied to the second node n2 in the data charging period of the display mode, and thus has the above-described effects. Also, the pixel P of the second modification example may prevent the current (flowing in the driving transistor DT) from flowing to the i+1st data line Di+1 when the pre-charging voltage Vpre is applied to the second node n2 in the initialization period of the detection mode, and thus has the above-described effects.

Figure 13:
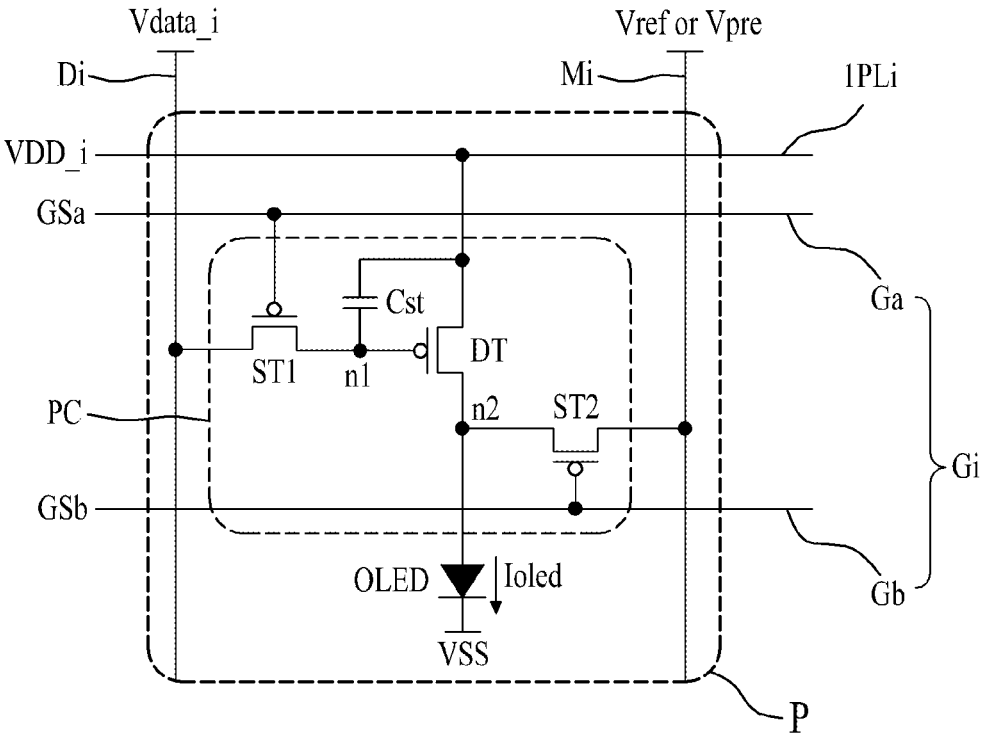
FIG. 13 is a diagram for describing a third modification example of a pixel in the organic light emitting display device according to the first embodiment.

FIG. 13 is a diagram for describing a third modification example of a pixel in the organic light emitting display device according to the first embodiment.

With reference to FIGS. 2 and 13, a pixel P according to the third modification example of the present embodiments may include a light emitting element OLED and a pixel circuit PC that includes first and second switching transistors ST1 and ST2, a driving transistor DT, and a capacitor Cst. With the exception that each of the transistors ST1, ST2 and DT is a P-type TFT, the pixel P of the third modification example having the above-described configuration may be configured identically or similarly to the above-described pixel of FIG. 3. Hereinafter, only different elements will be described.

Because each of the first and second switching transistors ST1 and ST2 and the driving transistor DT are a P-type TFT, the row driver 124 may respectively supply first and second gate signals GSa and GSb having the gate-on voltage level (which is a low level) to first and second gate lines Ga and Gb, and simultaneously supply a first driving voltage VDD_i having a first voltage level V1 to a first driving power line 1PLi, during a data charging period t1 of each pixel P. Here, the first voltage level V1 is lower than a second voltage level V2, and is equal to or lower than a voltage of a second driving voltage VSS terminal connected to a cathode of the light emitting element OLED. The column driver 122 may supply a negative data voltage Vdata to a data line Di, and supplies a reference voltage Vref or a pre-charging voltage Vpre having a certain voltage level to a dummy line Mi.

The capacitor Cst may be connected between a gate electrode and a source electrode (or a first driving power line) of the driving transistor DT because the driving transistor DT is the P-type TFT. The capacitor Cst may store a difference voltage between a first driving voltage VDD_i supplied to the first driving power line 1PLi and a data voltage Vdata supplied to the data line Di, and may turn on the driving transistor DT according to the stored voltage.

The reference voltage Vref supplied to the dummy line Mi may initialize a voltage of the second node n2, for example, a voltage at an anode of the light emitting element OLED.

The first driving voltage VDD_i may be set as a voltage that is equal to or lower than the voltage of the second driving voltage VSS terminal connected to the cathode of the light emitting element OLED when a voltage is charged into the capacitor Cst, and thus may prevent a current (flowing in the driving transistor DT) from flowing to the dummy line Mi. That is, when the voltage is charged into the capacitor Cst, a voltage at a drain electrode of the driving transistor DT is equal to or lower than a voltage at a source of the driving transistor DT due to the first voltage level V1 of the first driving voltage VDD_i, and thus, a current does not flow in the driving transistor DT. In addition, when the voltage is charged into the capacitor Cst, the first driving power line 1PLi may be floated.

The pixel P according to the third modification example of the present embodiments, as described above, may operate in the display mode or the detection mode.

Figure 14:
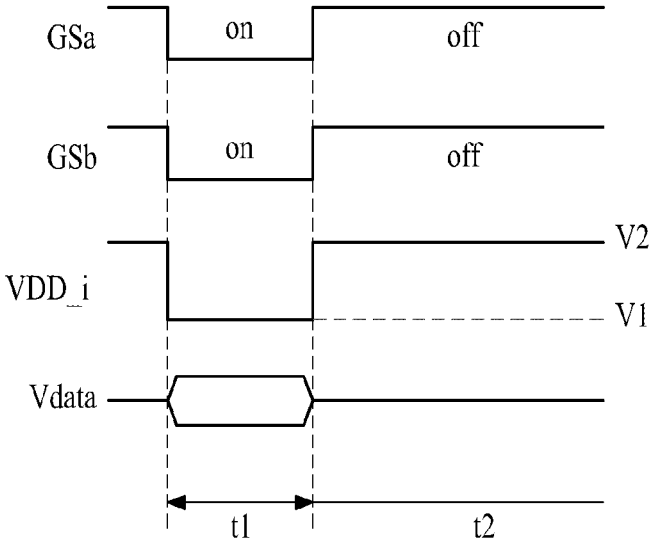
FIG. 14 is a waveform diagram showing a plurality of driving waveforms in a display mode of a pixel of FIG. 13.

The display mode of the pixel P according to the third modification example, as shown in the waveform diagram of FIG. 14, may be divided into a data charging period t1 and a light emitting period t2.

With the exception that the voltage of the second node n2 may be initialized to the reference voltage Vref and a difference voltage "VDD_i−Vdata" between a high-level voltage VDD_i and the data voltage Vdata may be stored in the capacitor Cst, the data charging period t1 may be the same as or similar to the data charging period of the display mode of FIG. 3 for each pixel, and thus, the description of FIG. 3 can be applied to the data charging period t1.

With the exception that the light emitting element OLED emits light with a data current Ioled that may be decided based on the difference voltage "VDD_i−Vdata" (stored in the capacitor Cst during the data charging period t1) between the high-level voltage VDD_i and the data voltage Vdata, the light emitting period t2 may be the same as or similar to the light emitting period of the display mode of FIG. 3 for each pixel, and thus, the description of FIG. 3 can be applied to the light emitting period t2.

Figure 15:
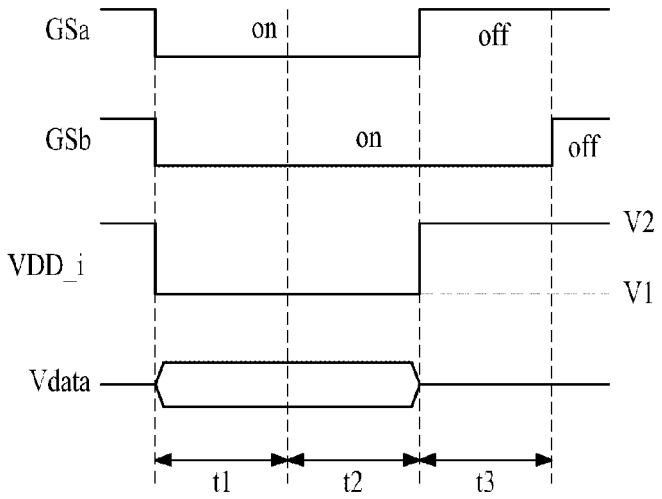
FIG. 15 is a waveform diagram showing a plurality of driving waveforms in a detection mode of the pixel of FIG. 13.

The detection mode of the pixel P according to the third modification example, as shown in the waveform diagram of FIG. 15, may be divided into an initialization period t1, a detection voltage charging period t2, and a voltage detecting period t3.

With the exception that the voltage of the second node n2 may be initialized to the pre-charging voltage Vpre and the difference voltage "VDD_i−Vdata" between the high-level voltage VDD_i and the data voltage Vdata for detection may be stored in the capacitor Cst, the initialization period t1 may be the same as or similar to the initialization period of the detection mode of FIG. 3 for each pixel, and thus, the description of FIG. 3 can be applied to the initialization period t1.

With the exception that the dummy line Mi may be floated and the floated dummy line Mi is charged with a current which flows in the driving transistor DT with the data voltage Vdata for detection which is continuously supplied subsequent to the initialization period t1, the detection voltage charging period t2 may be the same as or similar to the detection voltage charging period of the detection mode of FIG. 3 for each pixel, and thus, the description of FIG. 3 can be applied to the detection voltage charging period t2.

Similar to the voltage detecting period of the detection mode of FIG. 3 for each pixel, in the voltage detecting period t3, the voltage which is charged into the dummy line Mi during the detection voltage charging period t2 may be detected, and the detected voltage is converted into detection data Dsen, which is supplied to the timing controller 126.

Therefore, the organic light emitting display device including the pixel P of the third modification example can provide the same or similar effect as the organic light emitting display device including the pixel of FIG. 3.

Figure 16:
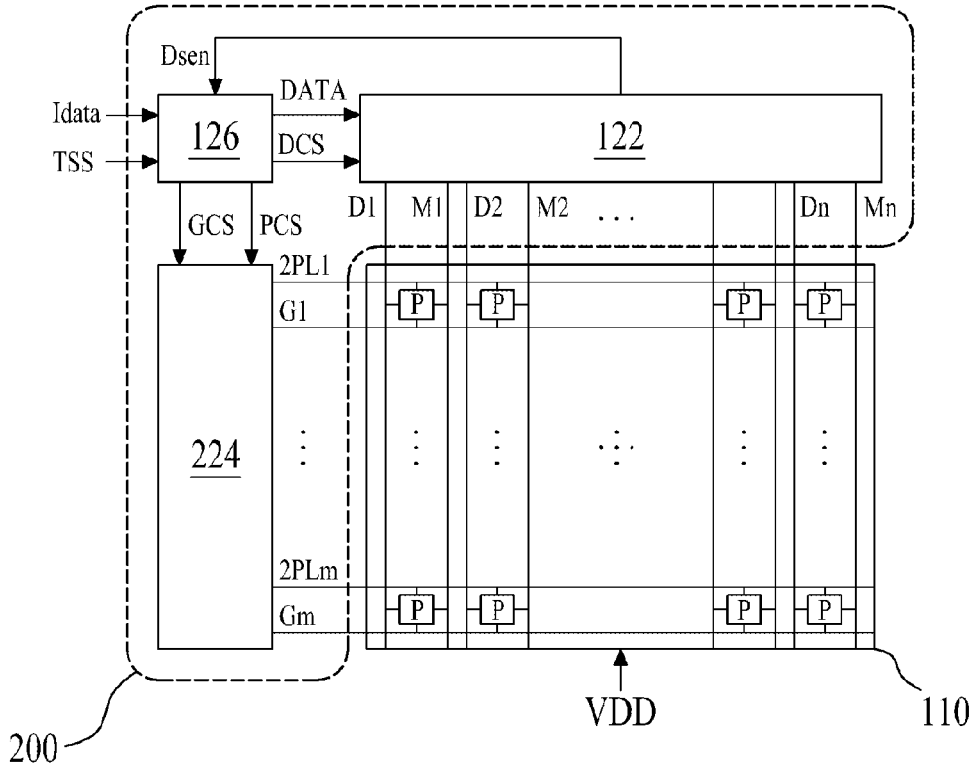
FIG. 16 is a diagram for describing an organic light emitting display device according to a second embodiment.
Figure 17:
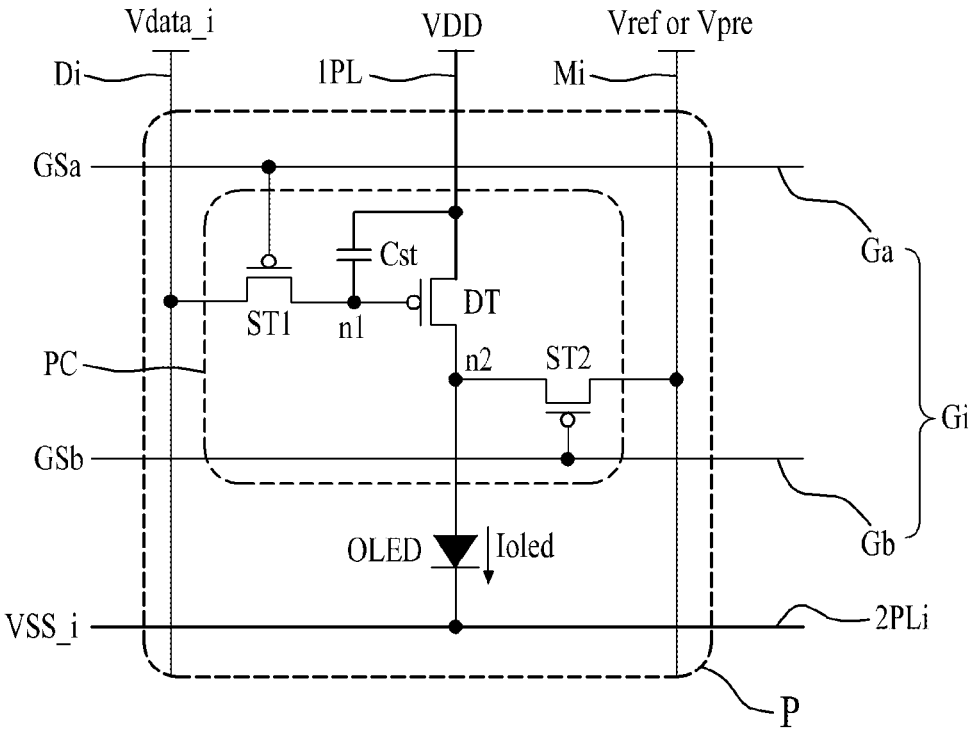
FIG. 17 is a circuit diagram for describing a pixel structure of FIG. 16.

FIG. 16 is a diagram for describing an organic light emitting display device according to a second embodiment, and FIG. 17 is a circuit diagram for describing a pixel structure of FIG. 16.

With reference to FIGS. 16 and 17, the organic light emitting display device according to the second embodiment may include a display panel 110 and a panel driver 200.

The display panel 110 may include a plurality of pixels P that are selectively driven in a data charging period, in which a difference voltage "VDD−Vdata" between a first driving voltage VDD and a data voltage Vdata may be charged into a capacitor Cst connected between a gate and source of a driving transistor DT receiving the first driving voltage VDD, and a light emitting period in which an light emitting element OLED may emit light with a data current Ioled that flows from a first driving voltage VDD_i terminal to a second driving voltage VSS_i terminal through a driving transistor DT according to the charged voltage of the capacitor Cst.

A pixel circuit PC of each of the plurality of pixels P may be configured identically or similarly to the pixel circuit PC of FIG. 13. With the exception that the first driving voltage VDD may be continuously maintained at the second voltage level V2 and the second driving voltage VSS_i has different voltage levels in the data charging period and the light emitting period, the pixel circuit PC may be the same as or similar to the pixel circuit PC of FIG. 13, and thus, the description of FIG. 13 is applied to the pixel circuit PC. Hereinafter, only different elements will be described.

Figure 18:
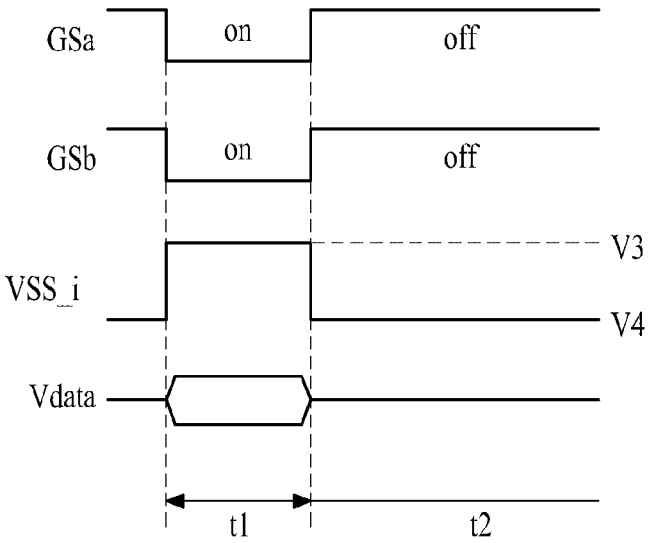
FIG. 18 is a waveform diagram showing a plurality of driving waveforms in a display mode of a pixel of FIG. 17.
Figure 19:
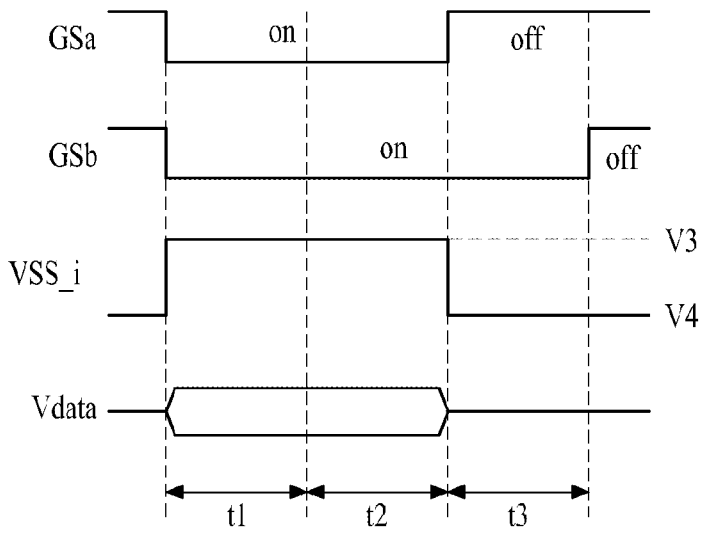
FIG. 19 is a waveform diagram showing a plurality of driving waveforms in a detection mode of a pixel of FIG. 17.

In the display mode, as shown in FIG. 18, the second driving voltage VSS_i may have a third voltage level V3 which is equal to or higher than the first driving voltage VDD during the data charging period t1, and may have a fourth voltage level V4 lower than the third voltage level V3 during the light emitting period t2. Also, in the detection mode, as shown in FIG. 19, the second driving voltage VSS_i may have the third voltage level V3 during the initialization period t1, and may have the fourth voltage level V4 during the detection voltage charging period t2 and the voltage detecting period t3.

The second driving voltage VSS_i may be set to a voltage level equal to or higher than the first driving voltage VDD when a voltage is charged into the capacitor Cst, and thus may prevent a current (flowing in the driving transistor DT) from flowing to the dummy line Mi. That is, when voltage is charged into the capacitor Cst, a voltage at a source of the driving transistor DT is equal to or higher than a voltage at a drain of the driving transistor DT due to the third voltage level V3 of the second driving voltage VSS_i, and thus, a current does not flow in the driving transistor DT.

The panel driver 200 may drive each pixel P in the data charging period and the light emitting period during the display mode of the display panel 110, and during the detection mode of the display panel 110, the panel driver 200 may drive each pixel P in the initialization period, the detection voltage period, and the voltage detecting period. To this end, the panel driver 200 may include a column driver 122, a row driver 224, and a timing controller 126. Except for the row driver 224, the panel driver 200 may be the same as or similar to the panel driver 120 of FIG. 2.

The row driver 224 may be connected to a plurality of gate line groups G1 to Gm and a plurality of second driving power lines 2PL1 to 2PLm, and may operate in the display mode or the detection mode according to a mode controlled by the timing controller 126.

In the display mode, as shown in FIG. 18, the row driver 224 may respectively supply first and second gate signals GSa and GSb having the gate-on voltage level to first and second gate lines Ga and Gb and simultaneously supply the second driving voltage VSS_i having the third voltage level V3 to the second driving power lines 2PL1 to 2PLm at every data charging period t1 of each pixel P, and respectively supply the first and second gate signals GSa and GSb having the gate-off voltage level to the first and second gate lines Ga and Gb and simultaneously supply the second driving voltage VSS_i having the fourth voltage level V4 to the second driving power lines 2PL1 to 2PLm at every light emitting period t2 of each pixel P. In the display mode, the row driver 224 may float a corresponding second driving power line during the data charging period t1 of each pixel P.

In the detection mode, as shown in FIG. 19, the row driver 224 may respectively supply the first and second gate signals GSa and GSb having the gate-on voltage level to first and second gate lines Ga and Gb and may simultaneously supply the second driving voltage VSS_i having the third voltage level V3 to the second driving power lines 2PL1 to 2PLm at every initialization period t1 and detection voltage charging period t2 of each pixel P, and may respectively supply the first gate signal GSa having the gate-off voltage level and the second gate signal GSb having the gate-on voltage level to the first and second gate lines Ga and Gb and simultaneously supply the first driving voltage VDD having the fourth voltage level V4 to the second driving power lines 2PL1 to 2PLm at every voltage detecting period t3 of each pixel P. In the detection mode, the row driver 224 may float a corresponding second driving power line during the initialization period t1 and detection voltage charging period t2 of each pixel P.

The organic light emitting display device according to the second embodiment may operate in the display mode and the detection mode identically or similarly to the organic light emitting display device including the pixel of FIG. 13. With the exception that the first driving voltage VDD may be continuously maintained at a predetermined voltage level and the second driving voltage VSS_i may be changed to a voltage level equal to or higher than the first driving voltage VDD when charging a voltage into the capacitor Cst of each pixel P in each of the display mode and the detection mode, the organic light emitting display device according to the second embodiment may be the same as or similar to the organic light emitting display device including the pixel of FIG. 13, and thus, the description of FIG. 13 is applied to the organic light emitting display device according to the second embodiment.

When charging a voltage into the capacitor Cst of each pixel P, the organic light emitting display device according to the second embodiment may maintain the first driving voltage VDD at a predetermined constant voltage level, and may change the second driving voltage VSS_i to a voltage level equal to or higher than the first driving voltage VDD. Therefore, the features of the organic light emitting display device according to the second embodiment may be applied to various types of pixel structures. Hereinafter, various modification examples of a pixel to which the features of the present embodiments are applied will be described.

Figure 20:
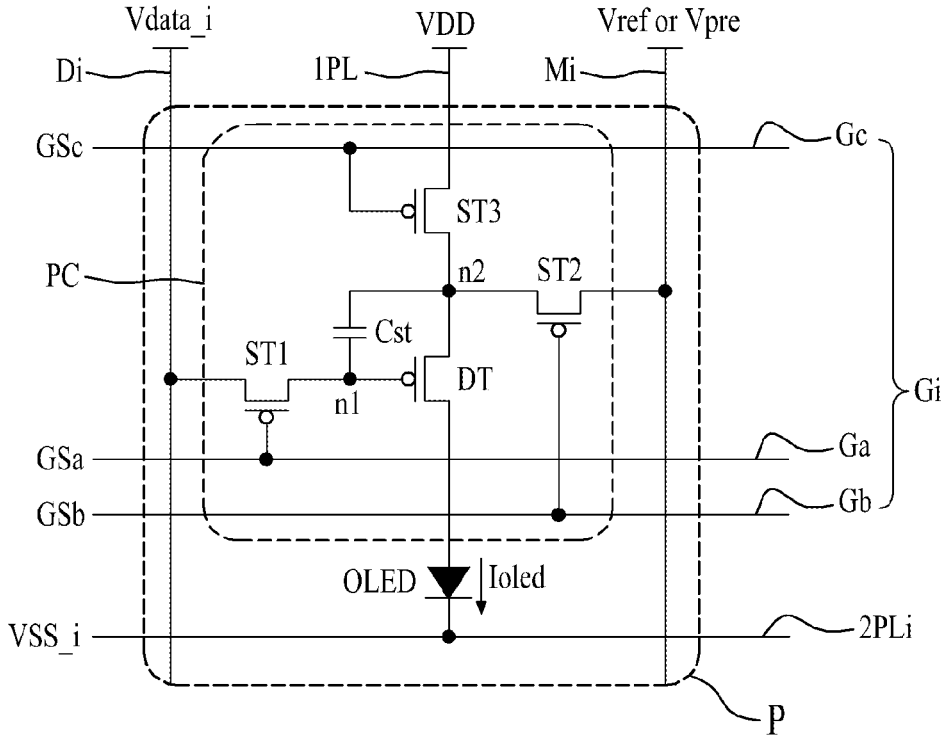
FIG. 20 is a diagram for describing a fourth modification example of a pixel in the organic light emitting display device according to the second embodiment.

FIG. 20 is a diagram for describing a fourth modification example of a pixel in the organic light emitting display device according to the second embodiment.

With reference to FIGS. 16 and 20, a pixel P according to the fourth modification example of the present embodiments may include a light emitting element OLED and a pixel circuit PC that includes first to third switching transistors ST1 to ST3, a driving transistor DT, and a capacitor Cst. With the exception that the pixel P having the above-described configuration may further include a third gate line Gc added to each gate line group Gi, that the third switching transistor ST3 may be connected to a high-level power line 1PL and the driving transistor DT, and that the second switching transistor ST2 is connected to a source of the driving transistor DT, the pixel P of the fourth modification example may be configured identically or similarly to the above-described pixel of FIG. 17. Hereinafter, only different elements will be described.

The second switching transistor ST2 may include a gate electrode connected to a second gate line Gb, a first electrode connected to an adjacent dummy line Mi, and a second electrode connected to a second node n2 that may be a source electrode of the driving transistor DT. The second switching transistor ST2 may supply a reference voltage Vref (or a pre-charging voltage Vpre), supplied to the dummy line Mi, to the second node n2 (e.g., the source of the driving transistor DT) according to a gate-on voltage level supplied to the second gate line Gb.

The third switching transistor ST3 may include a gate electrode connected to the third gate line Gc, a first electrode connected to the high-level power line 1PL, and a second electrode connected to the second node n2 that may be the source electrode of the driving transistor DT. The third switching transistor ST3 may supply a high-level voltage VDD, supplied to the high-level power line 1PL, to the second node n2 (e.g., the source electrode of the driving transistor DT) according to the gate-on voltage level supplied to the third gate line Gc.

The driving transistor DT may include a gate electrode connected to a first node n1, a source electrode connected to the second node n2, and a drain electrode connected to an anode of the light emitting element OLED. The driving transistor DT may output a current based on a voltage of the capacitor Cst by using the high-level voltage VDD supplied through the third switching transistor ST3.

To drive the pixel P according to the fourth modification example of the present embodiments in the display mode or the detection mode, the row driver 224 of FIG. 16 may additionally generate a third gate signal GSc in addition to the first and second gate signals GSa and GSb supplied to the gate line groups G1 to Gm, and may supply the third gate signal GSc to the third gate line Gc of each of the gate line groups G1 to Gm.

Figure 21:
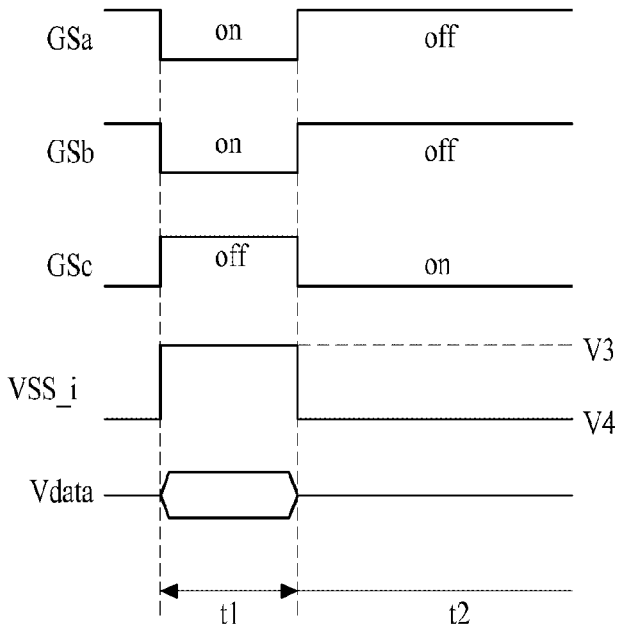
FIG. 21 is a waveform diagram showing a plurality of driving waveforms in a display mode of a pixel of FIG. 20.

In the display mode of each pixel, as shown in FIG. 21, the row driver 224 may respectively supply the first and second gate signals GSa and GSb having the gate-on voltage level and the third gate signal GSc having the gate-off voltage level to the first to third gate lines Ga, Gb, and Gc during the data charging period t1, and may respectively supply the first and second gate signals GSa and GSb having the gate-off voltage level and the third gate signal GSc having the gate-on voltage level to the first to third gate lines Ga, Gb, and Gc during the light emitting period t2.

Figure 22:
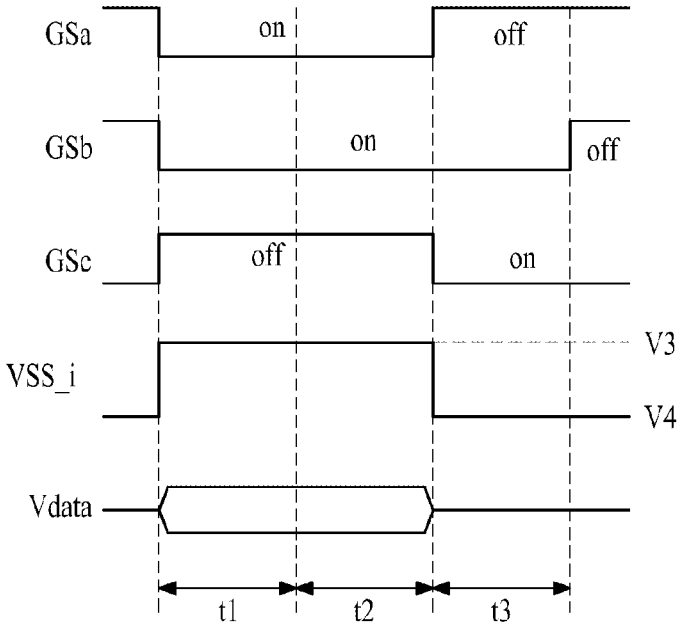
FIG. 22 is a waveform diagram showing a plurality of driving waveforms in a detection mode of a pixel of FIG. 20.

In the detection mode of each pixel, as shown in FIG. 22, the row driver 224 may respectively supply the first and second gate signals GSa and GSb having the gate-on voltage level and the third gate signal GSc having the gate-off voltage level to the first to third gate lines Ga, Gb, and Gc during the initialization period t1 and the detection voltage charging period t2, and may respectively supply the first gate signal GSa having the gate-off voltage level and the second and third gate signals GSb and GSc having the gate-on voltage level to the first to third gate lines Ga, Gb, and Gc during the voltage detecting period t3.

The pixel P according to the fourth modification example of the present embodiments, as described above, may operate in the display mode or the detection mode.

The display mode of the pixel P according to the fourth modification example, as shown in the waveform diagram of FIG. 21, may be divided into a data charging period t1 and a light emitting period t2.

In the data charging period t1, the first and second switching transistors ST1 and ST2 may be turned on, the third switching transistor ST3 may be turned off, and a second driving voltage VSS_i may be changed to a third voltage level V3. Therefore, a data voltage Vdata may be supplied to a first node n1 through the first switching transistor ST1, and the reference voltage Vref may be supplied to the second node n2 through the second switching transistor ST2. At this time, the third switching transistor ST3 may be turned off, and thus, the high-level voltage VDD may not be not supplied to the second node n2. Accordingly, a difference voltage "Vdata−Vref" between the data voltage Vdata and the reference voltage Vref may be charged into the capacitor Cst in the data charging period t1. When a current flows in the driving transistor DT with the voltage charged into the capacitor Cst, the light emitting element OLED may emit light. However, the second driving voltage VSS_i having the third voltage level V3 equal to or higher than the first driving voltage VDD may be supplied to a cathode of the light emitting element OLED during the data charging period t1 to prevent a current from flowing in the driving transistor DT, thereby preventing the light emitting element OLED from emitting light when a voltage is charged into the capacitor Cst.

In the light emitting period t2, the first and second switching transistors ST1 and ST2 may be turned off, the third switching transistor ST3 may be turned on, and the second driving voltage VSS_i may be changed to a fourth voltage level V4. Therefore, in the light emitting period t2, the driving transistor DT may be turned on with the voltage "Vdata−Vref" which is stored in the capacitor Cst during the data charging period t1, and as expressed for example in Equation (2), the light emitting element OLED may emit light in proportion to a data current Ioled flowing in the driving transistor DT. That is, in the light emitting period t2, the first and second switching transistors ST1 and ST2 may be turned off and simultaneously the third switching transistor ST3 may be turned on, the first driving voltage VDD_i may be supplied to the drain of the driving transistor DT, the second driving voltage VSS_i may be changed to the fourth voltage level V4, a current may flow in the driving transistor DT, the light emitting element OLED thereby emitting light in proportion to the current to cause rising of a voltage at the anode of the light emitting element OLED, and the gate-source voltage "Vgs" of the driving transistor DT may be continuously held with the voltage of the capacitor Cst, thereby enabling the light emitting element OLED to continuously emit light until a next data charging period t1.

The detection mode of the pixel P according to the fourth modification example, as shown in the waveform diagram of FIG. 22, may be divided into an initialization period t1, a detection voltage charging period t2, and a voltage detecting period t3.

In the initialization period t1, the first and second switching transistors ST1 and ST2 may be turned on, the third switching transistor ST3 may be turned off, and the second driving voltage VSS_i may be changed to the third voltage level V3. Therefore, a data voltage Vdata for detection may be supplied to the first node n1 through the first switching transistor ST1, and the pre-charging voltage Vpre may be supplied to the second node n2 through the second switching transistor ST2. At this time, the third switching transistor ST3 may be turned off, and thus, the high-level voltage VDD may not be supplied to the second node n2. Accordingly, a difference voltage "Vdata−Vpre" between the data voltage Vdata for detection and the pre-charging voltage Vpre may be charged into the capacitor Cst in the initialization period t1. When a voltage is charged into the capacitor Cst in the initialization period t1, similar to the data charging period t1 of the display mode, a current does not flow in the light emitting element OLED due to the second driving voltage VSS_i having the third voltage level V3.

In the detection voltage charging period t2, the dummy line Mi may be floated by the column driver 122 under the same or similar condition as the initialization period t1. Therefore, the current which flows in the driving transistor DT with the data voltage Vdata may be charged into the floated dummy line Mi through the second switching transistor ST2.

In the voltage detecting period t3, the first switching transistor ST1 may be turned off, the second switching transistor ST2 may be turned on, the third switching transistor ST2 may be turned on, the second driving voltage VSS_i may be changed to the fourth voltage level V4, and the dummy line Mi may be connected to the column driver 122. Therefore, the column driver 122 may detect the voltage charged into the dummy line Mi, convert the detected voltage (e.g., a voltage corresponding to the threshold voltage of the driving transistor DT) into detection data Dsen, and supply the detection data Dsen to the timing controller 126.

Figure 23:
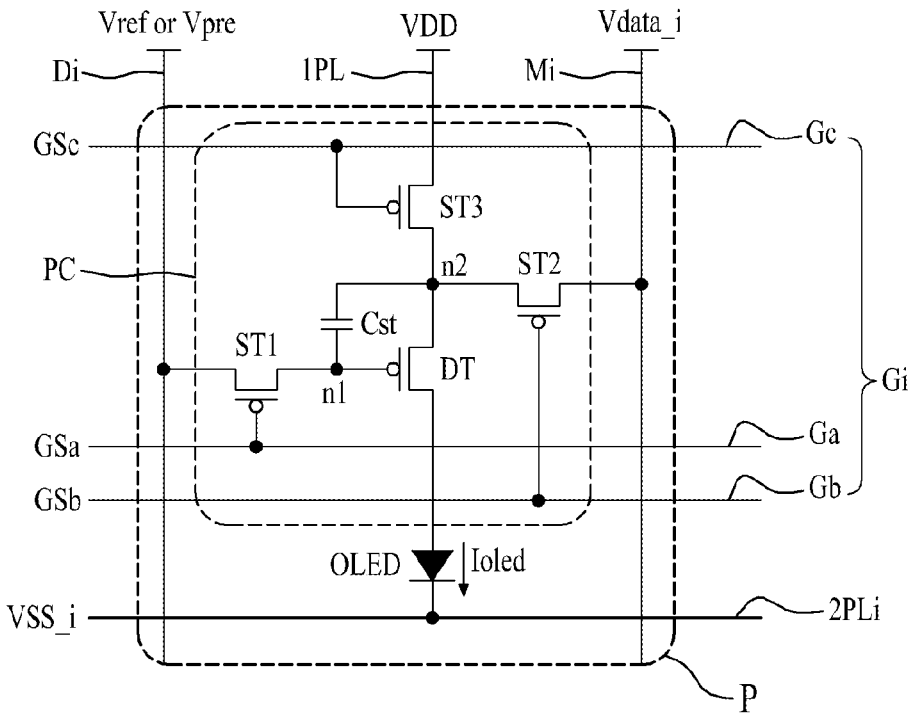
FIG. 23 is a diagram for describing a fifth modification example of a pixel in the organic light emitting display device according to the second embodiment.

FIG. 23 is a diagram for describing a fifth modification example of a pixel in the organic light emitting display device according to the second embodiment.

With reference to FIGS. 16 and 23, a pixel P according to the fifth modification example of the present embodiments may include a light emitting element OLED and a pixel circuit PC that includes first to third switching transistors ST1 to ST3, a driving transistor DT, and a capacitor Cst. With the exception that a first electrode of the first switching transistor ST1 may be connected to a dummy line Mi and a first electrode of the second switching transistor ST2 may be connected to a data line Di, the pixel P of the fifth modification example may be configured identically or similarly to the above-described pixel of FIG. 20. That is, the dummy line Mi and the data line Di have been changed in disposed position, for facilitating a pixel arrangement structure and a line connection structure.

Therefore, in each of the data charging period and detection period of the display mode, as described above, the pixel P of the fifth modification example may prevent a current from flowing in the driving transistor DT when applying a data voltage Vdata to a second node n2 through the second switching transistor ST2, and thus has the same or similar effect as the above-described pixel of FIG. 20.

Figure 24:
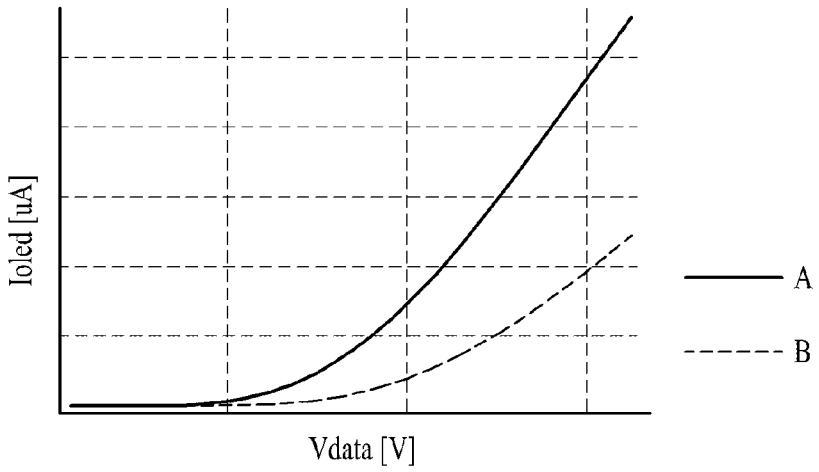
FIG. 24 is a graph for describing data efficiency of a present embodiment and data efficiency of a comparative example.

FIG. 24 is a graph for describing a data efficiency of a present embodiment and a data efficiency of a comparative example, and shows a current Ioled flowing in a light emitting element with respect to a data voltage Vdata.

Plot A in the graph of FIG. 24 is a plot according to a present embodiment as described above, and shows that when charging a voltage into a capacitor, a pixel was driven by changing a first driving voltage or a second driving voltage, and a current Ioled with respect to a data voltage Vdata was measured. Plot B in the graph of FIG. 24 is a plot according to a comparative example, and shows that when charging the voltage into the capacitor, a pixel was driven without changing the first driving voltage or the second driving voltage unlike the present embodiments, and the current Ioled with respect to the data voltage Vdata was measured.

In FIG. 24, it can be seen that the current Ioled with respect to the data voltage Vdata according to a present embodiment (A) increases more than in a comparative example (B). Therefore, the organic light emitting display device according to a present embodiment compensates for the threshold voltage/mobility of the driving transistor of each pixel P and moreover increases a current efficiency with respect to a data voltage, thus reducing power consumption.

As described above, the organic light emitting display device according to the present embodiments may reflect the threshold voltage/mobility of the driving transistor detected from each pixel in data to compensate for a threshold voltage deviation and mobility deviation of the driving transistors of the respective pixels at intervals or in real time, thus enhancing brightness uniformity.

Moreover, the organic light emitting display device according to the present embodiments may change the level of the first driving voltage supplied to the driving transistor and the level of the second driving voltage when the gate-source voltage of the driving transistor is changed into the capacitor, and consequently increases a current efficiency with respect to a data voltage, thus reducing power consumption.

It will be apparent to those skilled in the art that various modifications and variations can be made in the present embodiments without departing from the spirit or scope of the inventions. Thus, it is intended that the present embodiments cover the modifications and variations of this invention provided they come within the scope of the appended claims and their equivalents.

What is claimed is:

1. An organic light emitting display device comprising:

a panel driver; and a display panel including a plurality of pixels, each of the plurality of pixels having a pixel circuit that has a driving transistor, a first driving voltage terminal connected to the driving transistor, a light emitting element, a second driving voltage terminal connected to the light emitting element, and a capacitor connected between a gate and source electrode of the driving transistor, wherein the panel driver is configured to drive the pixel circuit in:

a data charging period in which a difference voltage between a data voltage and a reference voltage is charged into the capacitor, and a light emitting period in which the driving transistor receives a first driving voltage from the first driving voltage terminal and is turned on according to the voltage charged into the capacitor during the data charging period, whereby a current is supplied to the light emitting element connected between the driving transistor and the second driving voltage terminal and the light emitting element thereby emits light;

the panel driver being configured to supply the data voltage and the reference voltage to the plurality of pixels at the data charging period, and configured to simultaneously change a level of the first driving voltage or the second driving voltage supplied to the plurality of pixels via the first driving voltage terminal and the second driving voltage terminal, respectively, at the data charging period.

2. The organic light emitting display device of claim 1, wherein the first driving voltage has different voltage levels in the data charging period and the light emitting period, and the second driving voltage is maintained at a predetermined voltage level in the data charging period and the light emitting period.

3. The organic light emitting display device of claim 2, wherein the display panel further comprises:

a plurality of gate line groups;

a plurality of data lines configured to intersect the plurality of gate line groups, and receive the data voltage;

a plurality of dummy lines formed in parallel with the plurality of data lines, and configured to receive the reference voltage; and a plurality of first driving power lines formed in parallel with the plurality of gate line groups, and configured to receive the first driving voltage.

4. The organic light emitting display device of claim 3, wherein the pixel circuit further comprises:

a first switching transistor having a gate electrode connected to a first gate line of a corresponding one of the plurality of gate line groups, a first electrode connected to a corresponding one of the plurality of data lines, and a second electrode connected to the gate electrode of the driving transistor; and a second switching transistor having a gate electrode connected to a second gate line of the corresponding one of the plurality of gate line groups, a first electrode connected to a corresponding one of the plurality of dummy lines, and a second electrode connected to the source electrode of the driving transistor, wherein a drain electrode of the driving transistor is connected to a corresponding one of the first driving power lines.

5. The organic light emitting display device of claim 3, wherein at every data charging period of each of the plurality of pixels, the panel driver supplies the reference voltage to a corresponding one of the plurality of dummy lines, and simultaneously converts pixel data into the data voltage to supply the data voltage to a corresponding one of the plurality of data lines, and the panel driver supplies the first driving voltage having a first voltage level to a corresponding one of the plurality of first driving power lines at every data charging period of each pixel, and supplies the first driving voltage having a second voltage level higher than the first voltage level to the corresponding first driving power line or floats the corresponding first driving power line at every light emitting period of each pixel.

6. The organic light emitting display device of claim 5, wherein the panel driver detects a voltage corresponding to at least one of a threshold voltage and mobility of a driving transistor of each pixel through a corresponding one of the plurality of dummy lines respectively connected to each pixel, converts the detected voltage into detection data, and converts input data into the pixel data on a basis of the detection data.

7. The organic light emitting display device of claim 3, wherein the pixel circuit further comprises:

a first switching transistor having a gate electrode connected to a first gate line of a corresponding one of the plurality of gate line groups, a first electrode connected to a corresponding one of the plurality of data lines, and a second electrode connected to the gate electrode of the driving transistor;

a second switching transistor having a gate electrode connected to a second gate line of the corresponding gate line group, a first electrode connected to a corresponding one of the plurality of dummy lines, and a second electrode connected to the source electrode of the driving transistor; and a third switching transistor having a gate electrode connected to a third gate line of the corresponding gate line group, a first electrode connected to a data line of an adjacent and next pixel, and a second electrode connected to the source electrode of the driving transistor, wherein a drain electrode of the driving transistor is connected to a corresponding one of the plurality of first driving power lines.

8. The organic light emitting display device of claim 7, wherein at every data charging period of each of the plurality of pixels, the panel driver supplies the reference voltage to the one dummy line corresponding to one of the plurality of pixels, and simultaneously converts pixel data into the data voltage to supply the data voltage to the one data line corresponding to the one of the plurality of pixels, and the panel driver supplies the first driving voltage having a first voltage level to the one first driving power line corresponding to the one of the plurality of pixels at every data charging period of each pixel, and supplies the first driving voltage having a second voltage level higher than the first voltage level to the corresponding first driving power line or floats the corresponding first driving power line at every light emitting period of each pixel.

9. The organic light emitting display device of claim 8, wherein, the panel driver detects a voltage corresponding to at least one of a threshold voltage and mobility of a driving transistor of an adjacent and previous pixel through the data line of the adjacent and next pixel, converts the detected voltage into detection data, and converts input data into the pixel data on a basis of the detection data, and the adjacent and previous pixel is a pixel that receives a data voltage from the data line connected to the first switching transistor.

10. The organic light emitting display device of claim 1, wherein, the first driving voltage is maintained at a predetermined voltage level in the data charging period and the light emitting period, and the second driving voltage has different voltage levels in the data charging period and the light emitting period.

11. The organic light emitting display device of claim 10, wherein the display panel further comprises:

a plurality of gate line groups;

a plurality of data lines configured to intersect the plurality of gate line groups, and receive the data voltage;

a plurality of dummy lines formed in parallel with the plurality of data lines, and configured to receive the reference voltage; and a plurality of second driving power lines formed in parallel with the plurality of gate line groups, and configured to receive the second driving voltage.

12. The organic light emitting display device of claim 11, wherein the pixel circuit further comprises:

a first switching transistor having a gate electrode connected to a first gate line of a corresponding one of the plurality of gate line groups, a first electrode connected to a corresponding one of the plurality of data lines, and a second electrode connected to the gate electrode of the driving transistor;

a second switching transistor having a gate electrode connected to a second gate line of the corresponding gate line group, a first electrode connected to a corresponding one of the plurality of dummy lines, and a second electrode connected to the source electrode of the driving transistor; and a third switching transistor having a gate electrode connected to a third gate line of the corresponding gate line group, a first electrode receiving the first driving voltage, and a second electrode connected to the source electrode of the driving transistor, wherein a drain electrode of the driving transistor is connected to the light emitting element.

13. The organic light emitting display device of claim 11, wherein, at every data charging period of each of the plurality of pixels, the panel driver supplies the reference voltage to the one of the plurality of dummy lines corresponding to one of the plurality of pixels, and simultaneously converts pixel data into the data voltage to supply the data voltage to the one of the plurality of data lines corresponding to the one of the plurality of pixels, and the panel driver supplies the second driving voltage having a third voltage level to one of the plurality of second driving power lines corresponding to one of the plurality of pixels at every data charging period of each pixel, and supplies the second driving voltage having a fourth voltage level lower than the third voltage level to the corresponding second driving power line or floats the corresponding second driving power line at every light emitting period of each pixel.

14. An organic light emitting display device comprising:

a panel driver; and a display panel including a plurality of pixels, each of the plurality of pixels having a pixel circuit that has a driving transistor, a first driving voltage terminal connected to the driving transistor, a light emitting element, a second driving voltage terminal connected to the light emitting element, and a capacitor connected between a gate and source electrode of the driving transistor, wherein the panel driver is configured to drive the pixel circuit in:

a data charging period in which a difference voltage between a first driving voltage and a data voltage is charged into the capacitor, and a light emitting period in which the driving transistor receiving the first driving voltage is turned on according to the voltage charged into the capacitor during the data charging period, whereby a current is supplied to the light emitting element connected between the driving transistor and the second driving voltage terminal and the light emitting element thereby emits light;

the panel driver being configured to supply the first driving voltage and the data voltage to the plurality of pixels at the data charging period, and configured to simultaneously change a level of the first driving voltage or the second driving voltage supplied to the plurality of pixels via the first driving voltage terminal and the second driving voltage terminal, respectively, at the data charging period.

15. The organic light emitting display device of claim 14, wherein, the first driving voltage has different voltage levels in the data charging period and the light emitting period, and the second driving voltage is maintained at a predetermined voltage level in the data charging period and the light emitting period.

16. The organic light emitting display device of claim 15, wherein the display panel further comprises:

a plurality of gate line groups;

a plurality of data lines configured to intersect the plurality of gate line groups, and receive the data voltage;

a plurality of dummy lines formed in parallel with the plurality of data lines, and configured to receive a reference voltage; and a plurality of first driving power lines formed in parallel with the plurality of gate line groups, and configured to receive the first driving voltage.

17. The organic light emitting display device of claim 16, wherein, the pixel circuit further comprises:

a first switching transistor having a gate electrode connected to a first gate line of a corresponding one of the plurality of gate line groups, a first electrode connected to a corresponding one of the plurality of data lines, and a second electrode connected to the gate electrode of the driving transistor; and a second switching transistor having a gate electrode connected to a second gate line of the corresponding one of the plurality of gate line groups, a first electrode connected to a corresponding one of the plurality of dummy lines, and a second electrode connected to a drain electrode of the driving transistor, wherein the drain electrode of the driving transistor is connected to the light emitting element.

18. The organic light emitting display device of claim 14, wherein, the first driving voltage is maintained at a predetermined voltage level in the data charging period and the light emitting period, and the second driving voltage has different voltage levels in the data charging period and the light emitting period.

19. The organic light emitting display device of claim 18, wherein the display panel further comprises:

a plurality of gate line groups;

a plurality of data lines configured to intersect the plurality of gate line groups, and receive the data voltage;

a plurality of dummy lines formed in parallel with the plurality of data lines, and configured to receive a reference voltage; and a plurality of second driving power lines formed in parallel with the plurality of gate line groups, and configured to receive the second driving voltage.

20. The organic light emitting display device of claim 19, wherein, the pixel circuit further comprises:

a first switching transistor having a gate electrode connected to a first gate line a corresponding one of the plurality of gate line groups, a first electrode connected to a corresponding one of the plurality of data lines, and a second electrode connected to the gate electrode of the driving transistor; and a second switching transistor having a gate electrode connected to a second gate line of the corresponding gate line group, a first electrode connected to a corresponding one of the plurality of dummy lines, and a second electrode connected to a drain electrode of the driving transistor, wherein the drain electrode of the driving transistor is connected to the light emitting element.

* * * * *